US009984607B2

(12) United States Patent
Chaji

(10) Patent No.: US 9,984,607 B2
(45) Date of Patent: May 29, 2018

(54) SYSTEMS AND METHODS FOR AGING COMPENSATION IN AMOLED DISPLAYS

(71) Applicant: Ignis Innovation Inc., Waterloo (CA)

(72) Inventor: Gholamreza Chaji, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 0 days. days.

(21) Appl. No.: 15/689,210

(22) Filed: Aug. 29, 2017

(65) Prior Publication Data

US 2017/0358251 A1 Dec. 14, 2017

Related U.S. Application Data

(63) Continuation of application No. 13/481,790, filed on May 26, 2012, now Pat. No. 9,773,439.

(60) Provisional application No. 61/490,870, filed on May 27, 2011, provisional application No. 61/556,972, filed on Nov. 8, 2011.

(51) Int. Cl.

| | |
|---|---|
| ***G09G 5/02*** | (2006.01) |
| ***G09G 5/00*** | (2006.01) |
| ***G09G 3/00*** | (2006.01) |
| ***G09G 3/3291*** | (2016.01) |
| *G09G 3/3233* | (2016.01) |

(52) U.S. Cl.

CPC ..... *G09G 3/006* (2013.01); *G09G 3/3291* (2013.01); *G09G 3/3233* (2013.01); *G09G 2230/00* (2013.01); *G09G 2320/0295* (2013.01); *G09G 2320/043* (2013.01); *G09G 2320/045* (2013.01); *G09G 2330/12* (2013.01)

(58) Field of Classification Search

None

See application file for complete search history.

(56) References Cited

U.S. PATENT DOCUMENTS

| | | | |
|---|---|---|---|
| 3,506,851 | A | 4/1970 | Polkinghorn |
| 3,774,055 | A | 11/1973 | Bapat |
| 4,090,096 | A | 5/1978 | Nagami |
| 4,160,934 | A | 7/1979 | Kirsch |
| 4,295,091 | A | 10/1981 | Ponkala |
| 4,354,162 | A | 10/1982 | Wright |

(Continued)

FOREIGN PATENT DOCUMENTS

JP 2007-206590 A 8/2007

OTHER PUBLICATIONS

European Patent Office, Extended European Search Report in European Patent Application No. 17195377.1, dated Feb. 12, 2018 (8 pages).

*Primary Examiner* — Jennifer Mehmood
*Assistant Examiner* — Carl Adams
(74) *Attorney, Agent, or Firm* — Nixon Peabody LLP

(57) ABSTRACT

Circuits for programming, monitoring, and driving pixels in a display are provided. Circuits generally include a driving transistor to drive current through a light emitting device according to programming information which is stored on a storage device, such as a capacitor. One or more switching transistors are generally included to select the circuits for programming, monitoring, and/or emission. Circuits advantageously incorporate emission transistors to selectively couple the gate and source terminals of a driving transistor to allow programming information to be applied to the driving transistor independently of a resistance of a switching transistor.

22 Claims, 10 Drawing Sheets

(56) References Cited

U.S. PATENT DOCUMENTS 4,943,956 A 7/1990 Noro
4,996,523 A 2/1991 Bell
5,153,420 A 10/1992 Hack
5,198,803 A 3/1993 Shie
5,204,661 A 4/1993 Hack
5,266,515 A 11/1993 Robb
5,489,918 A 2/1996 Mosier
5,498,880 A 3/1996 Lee
5,557,342 A 9/1996 Eto
5,561,381 A 10/1996 Jenkins et al.
5,572,444 A 11/1996 Lentz
5,589,847 A 12/1996 Lewis
5,619,033 A 4/1997 Weisfield
5,648,276 A 7/1997 Hara
5,670,973 A 9/1997 Bassetti
5,684,365 A 11/1997 Tang
5,691,783 A 11/1997 Numao
5,714,968 A 2/1998 Ikeda
5,723,950 A 3/1998 Wei
5,744,824 A 4/1998 Kousai
5,745,660 A 4/1998 Kolpatzik
5,748,160 A 5/1998 Shieh
5,815,303 A 9/1998 Berlin
5,870,071 A 2/1999 Kawahata
5,874,803 A 2/1999 Garbuzov
5,880,582 A 3/1999 Sawada
5,903,248 A 5/1999 Irwin
5,917,280 A 6/1999 Burrows
5,923,794 A 7/1999 McGrath
5,945,972 A 8/1999 Okumura
5,949,398 A 9/1999 Kim
5,952,789 A 9/1999 Stewart
5,952,991 A 9/1999 Akiyama
5,982,104 A 11/1999 Sasaki
5,990,629 A 11/1999 Yamada
6,023,259 A 2/2000 Howard
6,069,365 A 5/2000 Chow
6,091,203 A 7/2000 Kawashima
6,097,360 A 8/2000 Holloman
6,144,222 A 11/2000 Ho
6,177,915 B1 1/2001 Beeteson
6,229,506 B1 5/2001 Dawson
6,229,508 B1 5/2001 Kane
6,246,180 B1 6/2001 Nishigaki
6,252,248 B1 6/2001 Sano
6,259,424 B1 7/2001 Kurogane
6,262,589 B1 7/2001 Tamukai
6,271,825 B1 8/2001 Greene
6,288,696 B1 9/2001 Holloman
6,304,039 B1 10/2001 Appelberg
6,307,322 B1 10/2001 Dawson
6,310,962 B1 10/2001 Chung
6,320,325 B1 11/2001 Cok
6,323,631 B1 11/2001 Juang
6,329,971 B2 12/2001 McKnight
6,356,029 B1 3/2002 Hunter
6,373,454 B1 4/2002 Knapp
6,377,237 B1 4/2002 Sojourner
6,392,617 B1 5/2002 Gleason
6,404,139 B1 6/2002 Sasaki et al.
6,414,661 B1 7/2002 Shen
6,417,825 B1 7/2002 Stewart
6,433,488 B1 8/2002 Bu
6,437,106 B1 8/2002 Stoner
6,445,369 B1 9/2002 Yang
6,475,845 B2 11/2002 Kimura
6,501,098 B2 12/2002 Yamazaki
6,501,466 B1 12/2002 Yamagishi
6,518,962 B2 2/2003 Kimura
6,522,315 B2 2/2003 Ozawa
6,525,683 B1 2/2003 Gu
6,531,827 B2 3/2003 Kawashima
6,541,921 B1 4/2003 Luciano, Jr. et al.
6,542,138 B1 4/2003 Shannon
6,555,420 B1 4/2003 Yamazaki
6,577,302 B2 6/2003 Hunter
6,580,408 B1 6/2003 Bae
6,580,657 B2 6/2003 Sanford
6,583,398 B2 6/2003 Harkin
6,583,775 B1 6/2003 Sekiya
6,594,606 B2 7/2003 Everitt
6,618,030 B2 9/2003 Kane
6,639,244 B1 10/2003 Yamazaki
6,668,645 B1 12/2003 Gilmour
6,677,713 B1 1/2004 Sung
6,680,580 B1 1/2004 Sung
6,687,266 B1 2/2004 Ma
6,690,000 B1 2/2004 Muramatsu
6,690,344 B1 2/2004 Takeuchi
6,693,388 B2 2/2004 Oomura
6,693,610 B2 2/2004 Shannon
6,697,057 B2 2/2004 Koyama
6,720,942 B2 4/2004 Lee
6,724,151 B2 4/2004 Yoo
6,734,636 B2 5/2004 Sanford
6,738,034 B2 5/2004 Kaneko
6,738,035 B1 5/2004 Fan
6,753,655 B2 6/2004 Shih
6,753,834 B2 6/2004 Mikami
6,756,741 B2 6/2004 Li
6,756,952 B1 6/2004 Decaux
6,756,958 B2 6/2004 Furuhashi
6,765,549 B1 7/2004 Yamazaki et al.
6,771,028 B1 8/2004 Winters
6,777,712 B2 8/2004 Sanford
6,777,888 B2 8/2004 Kondo
6,781,567 B2 8/2004 Kimura
6,806,497 B2 10/2004 Jo
6,806,638 B2 10/2004 Lih et al.
6,806,857 B2 10/2004 Sempel
6,809,706 B2 10/2004 Shimoda
6,815,975 B2 11/2004 Nara
6,828,950 B2 12/2004 Koyama
6,853,371 B2 2/2005 Miyajima
6,859,193 B1 2/2005 Yumoto
6,873,117 B2 3/2005 Ishizuka
6,876,346 B2 4/2005 Anzai
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky
6,911,960 B1 6/2005 Yokoyama
6,911,964 B2 6/2005 Lee
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura
6,940,214 B1 9/2005 Komiya
6,943,500 B2 9/2005 LeChevalier
6,947,022 B2 9/2005 McCartney
6,954,194 B2 10/2005 Matsumoto
6,956,547 B2 10/2005 Bae
6,975,142 B2 12/2005 Azami
6,975,332 B2 12/2005 Arnold
6,995,510 B2 2/2006 Murakami
6,995,519 B2 2/2006 Arnold
7,023,408 B2 4/2006 Chen
7,027,015 B2 4/2006 Booth, Jr.
7,027,078 B2 4/2006 Reihl
7,034,793 B2 4/2006 Sekiya
7,038,392 B2 5/2006 Libsch
7,053,875 B2 5/2006 Chou
7,057,359 B2 6/2006 Hung
7,061,451 B2 6/2006 Kimura
7,064,733 B2 6/2006 Cok
7,071,932 B2 7/2006 Libsch
7,088,051 B1 8/2006 Cok
7,088,052 B2 8/2006 Kimura
7,102,378 B2 9/2006 Kuo
7,106,285 B2 9/2006 Naugler
7,112,820 B2 9/2006 Change
7,116,058 B2 10/2006 Lo

(56) References Cited

U.S. PATENT DOCUMENTS 7,119,493 B2 10/2006 Fryer
7,122,835 B1 10/2006 Ikeda
7,127,380 B1 10/2006 Iverson
7,129,914 B2 10/2006 Knapp
7,161,566 B2 1/2007 Cok
7,164,417 B2 1/2007 Cok
7,193,589 B2 3/2007 Yoshida
7,224,332 B2 5/2007 Cok
7,227,519 B1 6/2007 Kawase
7,245,277 B2 7/2007 Ishizuka
7,246,912 B2 7/2007 Burger et al.
7,248,236 B2 7/2007 Nathan
7,262,753 B2 8/2007 Tanghe
7,274,363 B2 9/2007 Ishizuka
7,310,092 B2 12/2007 Imamura
7,315,295 B2 1/2008 Kimura
7,321,348 B2 1/2008 Cok
7,329,849 B2 2/2008 Kasai
7,339,560 B2 3/2008 Sun
7,355,574 B1 4/2008 Leon
7,358,941 B2 4/2008 Ono
7,368,868 B2 5/2008 Sakamoto
7,397,485 B2 7/2008 Miller
7,411,571 B2 8/2008 Huh
7,414,600 B2 8/2008 Nathan
7,423,617 B2 9/2008 Giraldo
7,453,054 B2 11/2008 Lee
7,474,285 B2 1/2009 Kimura
7,502,000 B2 3/2009 Yuki
7,528,812 B2 5/2009 Tsuge
7,535,449 B2 5/2009 Miyazawa
7,554,512 B2 6/2009 Steer
7,569,849 B2 8/2009 Nathan
7,576,718 B2 8/2009 Miyazawa
7,580,012 B2 8/2009 Kim
7,589,707 B2 9/2009 Chou
7,605,792 B2 10/2009 Son
7,609,239 B2 10/2009 Chang
7,619,594 B2 11/2009 Hu
7,619,597 B2 11/2009 Nathan
7,633,470 B2 12/2009 Kane
7,656,370 B2 2/2010 Schneider
7,675,485 B2 3/2010 Steer
7,800,558 B2 9/2010 Routley
7,847,764 B2 12/2010 Cok
7,859,492 B2 12/2010 Kohno
7,868,859 B2 1/2011 Tomida
7,876,294 B2 1/2011 Sasaki
7,898,509 B2 3/2011 Iida
7,924,249 B2 4/2011 Nathan
7,932,883 B2 4/2011 Klompenhouwer
7,969,390 B2 6/2011 Yoshida
7,978,187 B2 7/2011 Nathan
7,994,712 B2 8/2011 Sung
8,026,876 B2 9/2011 Nathan
8,031,180 B2 10/2011 Miyamoto et al.
8,049,420 B2 11/2011 Tamura
8,077,123 B2 12/2011 Naugler, Jr.
8,115,707 B2 2/2012 Nathan
8,208,084 B2 6/2012 Lin
8,223,177 B2 7/2012 Nathan
8,232,939 B2 7/2012 Nathan
8,259,044 B2 9/2012 Nathan
8,264,431 B2 9/2012 Bulovic
8,279,143 B2 10/2012 Nathan
8,294,696 B2 10/2012 Min et al.
8,314,783 B2 11/2012 Sambandan et al.
8,339,386 B2 12/2012 Leon
8,441,206 B2 5/2013 Myers
8,493,296 B2 7/2013 Ogawa
8,581,809 B2 11/2013 Nathan et al.
9,125,278 B2 9/2015 Nathan et al.
9,368,063 B2 6/2016 Chaji et al.
9,418,587 B2 8/2016 Chaji et al.
9,430,958 B2 8/2016 Chaji et al.
9,472,139 B2 10/2016 Nathan et al.
9,489,891 B2 11/2016 Nathan et al.
9,489,897 B2 11/2016 Jaffari et al.
9,502,653 B2 11/2016 Chaji
9,530,349 B2 12/2016 Chaji
9,530,352 B2 12/2016 Nathan et al.
9,536,460 B2 1/2017 Chaji et al.
9,536,465 B2 1/2017 Chaji et al.
9,589,490 B2 3/2017 Chaji et al.
9,633,597 B2 4/2017 Nathan et al.
9,640,112 B2 5/2017 Jaffari et al.
9,721,512 B2 8/2017 Soni et al.
9,741,279 B2 8/2017 Chaji et al.
9,741,282 B2 8/2017 Giannikouris et al.
9,761,170 B2 9/2017 Chaji et al.
9,773,439 B2 9/2017 Chaji et al.
9,773,441 B2 9/2017 Chaji et al.
9,786,209 B2 10/2017 Chaji et al.
2001/0002703 A1 6/2001 Koyama
2001/0009283 A1 7/2001 Arao
2001/0024181 A1 9/2001 Kubota
2001/0024186 A1 9/2001 Kane
2001/0026257 A1 10/2001 Kimura
2001/0030323 A1 10/2001 Ikeda
2001/0035863 A1 11/2001 Kimura
2001/0038367 A1 11/2001 Inukai
2001/0040541 A1 11/2001 Yoneda
2001/0043173 A1 11/2001 Troutman
2001/0045929 A1 11/2001 Prache
2001/0052606 A1 12/2001 Sempel
2001/0052940 A1 12/2001 Hagihara
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai
2002/0018034 A1 2/2002 Ohki
2002/0030190 A1 3/2002 Ohtani
2002/0047565 A1 4/2002 Nara
2002/0052086 A1 5/2002 Maeda
2002/0067134 A1 6/2002 Kawashima
2002/0084463 A1 7/2002 Sanford
2002/0101152 A1 8/2002 Kimura
2002/0101172 A1 8/2002 Bu
2002/0105279 A1 8/2002 Kimura
2002/0117722 A1 8/2002 Osada
2002/0122308 A1 9/2002 Ikeda
2002/0158587 A1 10/2002 Komiya
2002/0158666 A1 10/2002 Azami
2002/0158823 A1 10/2002 Zavracky
2002/0167471 A1 11/2002 Everitt
2002/0167474 A1 11/2002 Everitt
2002/0169575 A1 11/2002 Everitt
2002/0180369 A1 12/2002 Koyama
2002/0180721 A1 12/2002 Kimura
2002/0181276 A1 12/2002 Yamazaki
2002/0183945 A1 12/2002 Everitt
2002/0186214 A1 12/2002 Siwinski
2002/0190924 A1 12/2002 Asano
2002/0190971 A1 12/2002 Nakamura
2002/0195967 A1 12/2002 Kim
2002/0195968 A1 12/2002 Sanford
2003/0020413 A1 1/2003 Oomura
2003/0030603 A1 2/2003 Shimoda
2003/0043088 A1 3/2003 Booth
2003/0057895 A1 3/2003 Kimura
2003/0058226 A1 3/2003 Bertram
2003/0062524 A1 4/2003 Kimura
2003/0063081 A1 4/2003 Kimura
2003/0071821 A1 4/2003 Sundahl
2003/0076048 A1 4/2003 Rutherford
2003/0090447 A1 5/2003 Kimura
2003/0090481 A1 5/2003 Kimura
2003/0107560 A1 6/2003 Yumoto
2003/0111966 A1 6/2003 Mikami
2003/0122745 A1 7/2003 Miyazawa
2003/0122749 A1 7/2003 Booth, Jr. et al.
2003/0122813 A1 7/2003 Ishizuki
2003/0142088 A1 7/2003 LeChevalier

(56) References Cited

U.S. PATENT DOCUMENTS

2003/0146897 A1 8/2003 Hunter
2003/0151569 A1 8/2003 Lee
2003/0156101 A1 8/2003 Le Chevalier
2003/0169241 A1 9/2003 LeChevalier
2003/0174152 A1 9/2003 Noguchi
2003/0179626 A1 9/2003 Sanford
2003/0185438 A1 10/2003 Osawa
2003/0197663 A1 10/2003 Lee
2003/0210256 A1 11/2003 Mori
2003/0230141 A1 12/2003 Gilmour
2003/0230980 A1 12/2003 Forrest
2003/0231148 A1 12/2003 Lin
2004/0032382 A1 2/2004 Cok
2004/0041750 A1 3/2004 Abe
2004/0066357 A1 4/2004 Kawasaki
2004/0070557 A1 4/2004 Asano
2004/0070565 A1 4/2004 Nayar
2004/0090186 A1 5/2004 Kanauchi
2004/0090400 A1 5/2004 Yoo
2004/0095297 A1 5/2004 Libsch
2004/0100427 A1 5/2004 Miyazawa
2004/0108518 A1 6/2004 Jo
2004/0135749 A1 7/2004 Kondakov
2004/0140982 A1 7/2004 Pate
2004/0145547 A1 7/2004 Oh
2004/0150592 A1 8/2004 Mizukoshi
2004/0150594 A1 8/2004 Koyama
2004/0150595 A1 8/2004 Kasai
2004/0155841 A1 8/2004 Kasai
2004/0174347 A1 9/2004 Sun
2004/0174349 A1 9/2004 Libsch
2004/0174354 A1 9/2004 Ono
2004/0178743 A1 9/2004 Miller
2004/0183759 A1 9/2004 Stevenson
2004/0196275 A1 10/2004 Hattori
2004/0207615 A1 10/2004 Yumoto
2004/0227697 A1 11/2004 Mori
2004/0233125 A1 11/2004 Tanghe
2004/0239596 A1 12/2004 Ono
2004/0246246 A1 12/2004 Tobita
2004/0252089 A1 12/2004 Ono
2004/0257313 A1 12/2004 Kawashima
2004/0257353 A1 12/2004 Imamura
2004/0257355 A1 12/2004 Naugler
2004/0263437 A1 12/2004 Hattori
2004/0263444 A1 12/2004 Kimura
2004/0263445 A1 12/2004 Inukai
2004/0263541 A1 12/2004 Takeuchi
2005/0007355 A1 1/2005 Miura Hirotsuna
2005/0007357 A1 1/2005 Yamashita
2005/0007392 A1 1/2005 Kasai
2005/0017650 A1 1/2005 Fryer
2005/0024081 A1 2/2005 Kuo
2005/0024393 A1 2/2005 Kondo
2005/0030267 A1 2/2005 Tanghe
2005/0057484 A1 3/2005 Diefenbaugh
2005/0057580 A1 3/2005 Yamano
2005/0067970 A1 3/2005 Libsch
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki
2005/0088103 A1 4/2005 Kageyama
2005/0105031 A1 5/2005 Shih
2005/0110420 A1 5/2005 Arnold
2005/0110807 A1 5/2005 Chang
2005/0122294 A1 6/2005 Ben-David
2005/0140598 A1 6/2005 Kim
2005/0140610 A1 6/2005 Smith
2005/0145891 A1 7/2005 Abe
2005/0156831 A1 7/2005 Yamazaki
2005/0162079 A1 7/2005 Sakamoto
2005/0168416 A1 8/2005 Hashimoto
2005/0179626 A1 8/2005 Yuki
2005/0179628 A1 8/2005 Kimura
2005/0185200 A1 8/2005 Tobol
2005/0200575 A1 9/2005 Kim
2005/0206590 A1 9/2005 Sasaki
2005/0212787 A1 9/2005 Noguchi
2005/0219184 A1 10/2005 Zehner
2005/0225683 A1 10/2005 Nozawa
2005/0243076 A1 11/2005 Kim
2005/0248515 A1 11/2005 Naugler
2005/0269959 A1 12/2005 Uchino
2005/0269960 A1 12/2005 Ono
2005/0280615 A1 12/2005 Cok
2005/0280766 A1 12/2005 Johnson
2005/0285822 A1 12/2005 Reddy
2005/0285825 A1 12/2005 Eom
2006/0001613 A1 1/2006 Routley
2006/0007072 A1 1/2006 Choi
2006/0007206 A1 1/2006 Reddy et al.
2006/0007249 A1 1/2006 Reddy
2006/0012310 A1 1/2006 Chen
2006/0012311 A1 1/2006 Ogawa
2006/0015272 A1 1/2006 Giraldo et al.
2006/0022305 A1 2/2006 Yamashita
2006/0022907 A1 2/2006 Uchino et al.
2006/0027807 A1 2/2006 Nathan
2006/0030084 A1 2/2006 Young
2006/0038501 A1 2/2006 Koyama et al.
2006/0038758 A1 2/2006 Routley
2006/0038762 A1 2/2006 Chou
2006/0044227 A1 3/2006 Hadcock
2006/0061248 A1 3/2006 Cok
2006/0066533 A1 3/2006 Sato
2006/0077134 A1 4/2006 Hector et al.
2006/0077135 A1 4/2006 Cok
2006/0077142 A1 4/2006 Kwon
2006/0082523 A1 4/2006 Guo
2006/0092185 A1 5/2006 Jo
2006/0097628 A1 5/2006 Suh
2006/0097631 A1 5/2006 Lee
2006/0103324 A1 5/2006 Kim et al.
2006/0103611 A1 5/2006 Choi
2006/0125740 A1 6/2006 Shirasaki et al.
2006/0149493 A1 7/2006 Sambandan
2006/0170623 A1 8/2006 Naugler, Jr.
2006/0176250 A1 8/2006 Nathan
2006/0208961 A1 9/2006 Nathan
2006/0208971 A1 9/2006 Deane
2006/0214888 A1 9/2006 Schneider
2006/0231740 A1 10/2006 Kasai
2006/0232522 A1 10/2006 Roy
2006/0244697 A1 11/2006 Lee
2006/0256048 A1 11/2006 Fish et al.
2006/0261841 A1 11/2006 Fish
2006/0273997 A1 12/2006 Nathan
2006/0279481 A1 12/2006 Haruna
2006/0284801 A1 12/2006 Yoon
2006/0284802 A1 12/2006 Kohno
2006/0284895 A1 12/2006 Marcu
2006/0290614 A1 12/2006 Nathan
2006/0290618 A1 12/2006 Goto
2007/0001937 A1 1/2007 Park
2007/0001939 A1 1/2007 Hashimoto
2007/0008251 A1 1/2007 Kohno
2007/0008268 A1 1/2007 Park
2007/0008297 A1 1/2007 Bassetti
2007/0057873 A1 3/2007 Uchino
2007/0057874 A1 3/2007 Le Roy
2007/0069998 A1 3/2007 Naugler
2007/0075727 A1 4/2007 Nakano
2007/0076226 A1 4/2007 Klompenhouwer
2007/0080905 A1 4/2007 Takahara
2007/0080906 A1 4/2007 Tanabe
2007/0080908 A1 4/2007 Nathan
2007/0097038 A1 5/2007 Yamazaki
2007/0097041 A1 5/2007 Park
2007/0103411 A1 5/2007 Cok et al.
2007/0103419 A1 5/2007 Uchino
2007/0115221 A1 5/2007 Buchhauser
2007/0126672 A1 6/2007 Tada et al.

(56) References Cited

U.S. PATENT DOCUMENTS

2007/0164664 A1 7/2007 Ludwicki
2007/0164937 A1 7/2007 Jung et al.
2007/0164938 A1 7/2007 Shin
2007/0182671 A1 8/2007 Nathan
2007/0195020 A1 8/2007 Nathan
2007/0236134 A1 10/2007 Ho King-Yuan
2007/0236440 A1 10/2007 Wacyk
2007/0236517 A1 10/2007 Kimpe
2007/0241999 A1 10/2007 Lin
2007/0273294 A1 11/2007 Nagayama
2007/0285359 A1 12/2007 Ono
2007/0290957 A1* 12/2007 Cok ..... G09G 3/3225 345/77
2007/0290958 A1 12/2007 Cok
2007/0296672 A1 12/2007 Kim
2008/0001525 A1 1/2008 Chao
2008/0001544 A1 1/2008 Murakami
2008/0030518 A1 2/2008 Higgins
2008/0036706 A1* 2/2008 Kitazawa ..... G09G 3/3233 345/76
2008/0036708 A1 2/2008 Shirasaki
2008/0042942 A1 2/2008 Takahashi
2008/0042948 A1 2/2008 Yamashita
2008/0048951 A1 2/2008 Naugler, Jr.
2008/0055209 A1 3/2008 Cok
2008/0055211 A1 3/2008 Ogawa
2008/0074413 A1 3/2008 Ogura
2008/0088549 A1 4/2008 Nathan
2008/0088648 A1 4/2008 Nathan
2008/0111766 A1 5/2008 Uchino
2008/0116787 A1 5/2008 Hsu
2008/0117144 A1 5/2008 Nakano et al.
2008/0136770 A1 6/2008 Peker et al.
2008/0150845 A1 6/2008 Ishii
2008/0150847 A1 6/2008 Kim
2008/0158115 A1 7/2008 Cordes
2008/0158648 A1 7/2008 Cummings
2008/0191976 A1 8/2008 Nathan
2008/0198103 A1 8/2008 Toyomura
2008/0211749 A1 9/2008 Weitbruch
2008/0218451 A1 9/2008 Miyamoto
2008/0231558 A1 9/2008 Naugler
2008/0231562 A1 9/2008 Kwon
2008/0231625 A1 9/2008 Minami
2008/0238953 A1 10/2008 Ogura
2008/0246713 A1 10/2008 Lee
2008/0252223 A1 10/2008 Toyoda
2008/0252571 A1 10/2008 Hente
2008/0259020 A1 10/2008 Fisekovic
2008/0290805 A1 11/2008 Yamada
2008/0297055 A1 12/2008 Miyake
2009/0033598 A1 2/2009 Suh
2009/0058772 A1 3/2009 Lee
2009/0109142 A1 4/2009 Takahara
2009/0121994 A1 5/2009 Miyata
2009/0146926 A1 6/2009 Sung
2009/0160743 A1 6/2009 Tomida
2009/0174628 A1 7/2009 Wang
2009/0184901 A1 7/2009 Kwon
2009/0195483 A1 8/2009 Naugler, Jr.
2009/0201281 A1 8/2009 Routley
2009/0206764 A1 8/2009 Schemmann
2009/0207160 A1 8/2009 Shirasaki et al.
2009/0213046 A1 8/2009 Nam
2009/0244046 A1 10/2009 Seto
2009/0262047 A1 10/2009 Yamashita
2009/0309503 A1* 12/2009 Kim ..... G09G 3/3233 315/169.3
2010/0004891 A1 1/2010 Ahlers
2010/0007651 A1 1/2010 Kim
2010/0026725 A1 2/2010 Smith
2010/0033469 A1* 2/2010 Nathan ..... G09G 3/3233 345/211
2010/0039422 A1 2/2010 Seto
2010/0039458 A1* 2/2010 Nathan ..... G09G 3/3233 345/698
2010/0045646 A1 2/2010 Kishi
2010/0045650 A1 2/2010 Fish et al.
2010/0060911 A1 3/2010 Marcu
2010/0073335 A1 3/2010 Min et al.
2010/0073357 A1 3/2010 Min et al.
2010/0079419 A1 4/2010 Shibusawa
2010/0085282 A1 4/2010 Yu
2010/0103160 A1 4/2010 Jeon
2010/0134469 A1 6/2010 Ogura et al.
2010/0134475 A1 6/2010 Ogura et al.
2010/0165002 A1 7/2010 Ahn
2010/0194670 A1 8/2010 Cok
2010/0207960 A1 8/2010 Kimpe
2010/0225630 A1 9/2010 Levey
2010/0251295 A1 9/2010 Amento
2010/0277400 A1 11/2010 Jeong
2010/0315319 A1 12/2010 Cok
2011/0032232 A1 2/2011 Smith
2011/0050870 A1 3/2011 Hanari
2011/0063197 A1 3/2011 Chung
2011/0069051 A1 3/2011 Nakamura
2011/0069089 A1 3/2011 Kopf
2011/0069096 A1 3/2011 Li
2011/0074750 A1 3/2011 Leon
2011/0074762 A1 3/2011 Shirasaki et al.
2011/0149166 A1 6/2011 Botzas
2011/0169798 A1 7/2011 Lee
2011/0175895 A1 7/2011 Hayakawa
2011/0181630 A1 7/2011 Smith
2011/0199395 A1 8/2011 Nathan
2011/0227964 A1 9/2011 Chaji
2011/0242074 A1 10/2011 Bert et al.
2011/0273399 A1 11/2011 Lee
2011/0279488 A1 11/2011 Nathan et al.
2011/0292006 A1 12/2011 Kim
2011/0293480 A1 12/2011 Mueller
2012/0056558 A1 3/2012 Toshiya
2012/0062565 A1 3/2012 Fuchs
2012/0262184 A1 10/2012 Shen
2012/0299970 A1* 11/2012 Bae ..... G09G 3/3648 345/690
2012/0299973 A1 11/2012 Jaffari et al.
2012/0299978 A1 11/2012 Chaji
2013/0002527 A1 1/2013 Kim
2013/0027381 A1 1/2013 Nathan
2013/0057595 A1 3/2013 Nathan
2013/0112960 A1 5/2013 Chaji
2013/0135272 A1 5/2013 Park
2013/0162617 A1 6/2013 Yoon
2013/0201223 A1 8/2013 Li et al.
2013/0241813 A1 9/2013 Tanaka
2013/0309821 A1 11/2013 Yoo
2013/0321671 A1 12/2013 Cote
2014/0015824 A1 1/2014 Chaji et al.
2014/0022289 A1 1/2014 Lee
2014/0043316 A1 2/2014 Chaji et al.
2014/0055500 A1 2/2014 Lai
2014/0111567 A1 4/2014 Nathan et al.
2016/0275860 A1 9/2016 Wu

* cited by examiner

SYSTEMS AND METHODS FOR AGING COMPENSATION IN AMOLED DISPLAYS

CROSS REFERENCE TO RELATED APPLICATIONS

This application is a continuation of U.S. patent application Ser. No. 13/481,790, filed May 26, 2012, now allowed, which claims the benefit of, and priority to, U.S. Provisional Patent Application No. 61/490,870, filed May 27, 2011, and to U.S. Provisional Patent Application No. 61/556,972, filed Nov. 8, 2011, the contents of each of these applications being incorporated entirely herein by reference.

FIELD OF THE INVENTION

The present disclosure generally relates to circuits for use in displays, and methods of driving, calibrating, and programming displays, particularly displays such as active matrix organic light emitting diode displays.

BACKGROUND

Displays can be created from an array of light emitting devices each controlled by individual circuits (i.e., pixel circuits) having transistors for selectively controlling the circuits to be programmed with display information and to emit light according to the display information. Thin film transistors ("TFTs") fabricated on a substrate can be incorporated into such displays. TFTs tend to demonstrate non-uniform behavior across display panels and over time as the displays age. Compensation techniques can be applied to such displays to achieve image uniformity across the displays and to account for degradation in the displays as the displays age.

Some schemes for providing compensation to displays to account for variations across the display panel and over time utilize monitoring systems to measure time dependent parameters associated with the aging (i.e., degradation) of the pixel circuits. The measured information can then be used to inform subsequent programming of the pixel circuits so as to ensure that any measured degradation is accounted for by adjustments made to the programming. Such monitored pixel circuits may require the use of additional transistors and/or lines to selectively couple the pixel circuits to the monitoring systems and provide for reading out information. The incorporation of additional transistors and/or lines may undesirably decrease pixel-pitch (i.e., "pixel density").

SUMMARY

Aspects of the present disclosure provide pixel circuits suitable for use in a monitored display configured to provide compensation for pixel aging. Pixel circuit configurations disclosed herein allow for a monitor to access nodes of the pixel circuit via a monitoring switch transistor such that the monitor can measure currents and/or voltages indicative of an amount of degradation of the pixel circuit. Aspects of the present disclosure further provide pixel circuit configurations which allow for programming a pixel independent of a resistance of a switching transistor. Pixel circuit configurations disclosed herein include transistors for isolating a storage capacitor within the pixel circuit from a driving transistor such that the charge on the storage capacitor is not affected by current through the driving transistor during a programming operation.

According to some embodiments of the present disclosure, a system for compensating a pixel in a display array is provided. The system can include a pixel circuit, a driver, a monitor, and a controller. The pixel circuit is programmed according to programming information, during a programming cycle, and driven to emit light according to the programming information, during an emission cycle. The pixel circuit includes a light emitting device, a driving transistor, a storage capacitor, and an emission control transistor. The light emitting device is for emitting light during the emission cycle. The driving transistor is for conveying current through the light emitting device during the emission cycle. The storage capacitor is for being charged with a voltage based at least in part on the programming information, during the programming cycle. The emission control transistor is arranged to selectively connect, during the emission cycle, at least two of the light emitting device, the driving transistor, and the storage capacitor, such that current is conveyed through the light emitting device via the driving transistor according to the voltage on the storage capacitor. The driver is for programming the pixel circuit via a data line by charging the storage capacitor according to the programming information. The monitor is for extracting a voltage or a current indicative of aging degradation of the pixel circuit. The controller is for operating the monitor and the driver. The controller is configured to receive an indication of the amount of degradation from the monitor; receive a data input indicative of an amount of luminance to be emitted from the light emitting device; determine an amount of compensation to provide to the pixel circuit based on the amount of degradation; and provide the programming information to the driver to program the pixel circuit. The programming information is based at least in part on the received data input and the determined amount of compensation.

According to some embodiments of the present disclosure, a pixel circuit for driving a light emitting device is provided. The pixel circuit includes a driving transistor, a storage capacitor, an emission control transistor, and at least one switch transistor. The driving transistor is for driving current through a light emitting device according to a driving voltage applied across the driving transistor. The storage capacitor is for being charged, during a programming cycle, with the driving voltage. The emission control transistor is for connecting at least two of the driving transistor, the light emitting device, and the storage capacitor, such that current is conveyed through the driving transistor, during the emission cycle, according to voltage charged on the storage capacitor. The at least one switch transistor is for connecting a current path through the driving transistor to a monitor for receiving indications of aging information based on the current through the driving transistor, during a monitoring cycle.

According to some embodiments of the present disclosure, a pixel circuit is provided. The pixel circuit includes a driving transistor, a storage capacitor, one or more switch transistors, and an emission control transistor. The driving transistor is for driving current through a light emitting device according to a driving voltage applied across the driving transistor. The storage capacitor is for being charged, during a programming cycle, with the driving voltage. The one or more switch transistors are for connecting the storage capacitor to one or more data lines or reference lines providing voltages sufficient to charge the storage capacitor with the driving voltage, during the programming cycle. The emission control transistor is operated according to an emission line. The emission control transistor is for disconnecting the storage capacitor from the light emitting device during the programming cycle, such that the storage capacitor is charged independent of the capacitance of the light emitting device.

According to some embodiments of the present disclosure, a display system is provided. The display system includes a pixel circuit, a driver, a monitor, and a controller. The pixel circuit is programmed according to programming information, during a programming cycle, and driven to emit light according to the programming information, during an emission cycle. The pixel circuit includes a light emitting device for emitting light during the emission cycle. The pixel circuit also includes a driving transistor for conveying current through the light emitting device during the emission cycle. The current can be conveyed according to a voltage across a gate and a source terminal of the driving transistor. The pixel circuit also includes a storage capacitor for being charged with a voltage based at least in part on the programming information, during the programming cycle. The storage capacitor is connected across the gate and source terminals of the driving transistor. The pixel circuit also includes a first switch transistor connecting the source terminal of the driving transistor to a data line. The driver is for programming the pixel circuit via the data line by applying a voltage to a terminal of the storage capacitor that is connected to the source terminal of the driving transistor. The monitor is for extracting a voltage or a current indicative of aging degradation of the pixel circuit. The controller is for operating the monitor and the driver. The controller is configured to: receive an indication of the amount of degradation from the monitor; receive a data input indicative of an amount of luminance to be emitted from the light emitting device; determine an amount of compensation to provide to the pixel circuit based on the amount of degradation; and provide the programming information to the driver to program the pixel circuit. The programming information is based at least in part on the received data input and the determined amount of compensation.

The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

The foregoing and other advantages of the invention will become apparent upon reading the following detailed description and upon reference to the drawings.

Figure 1:
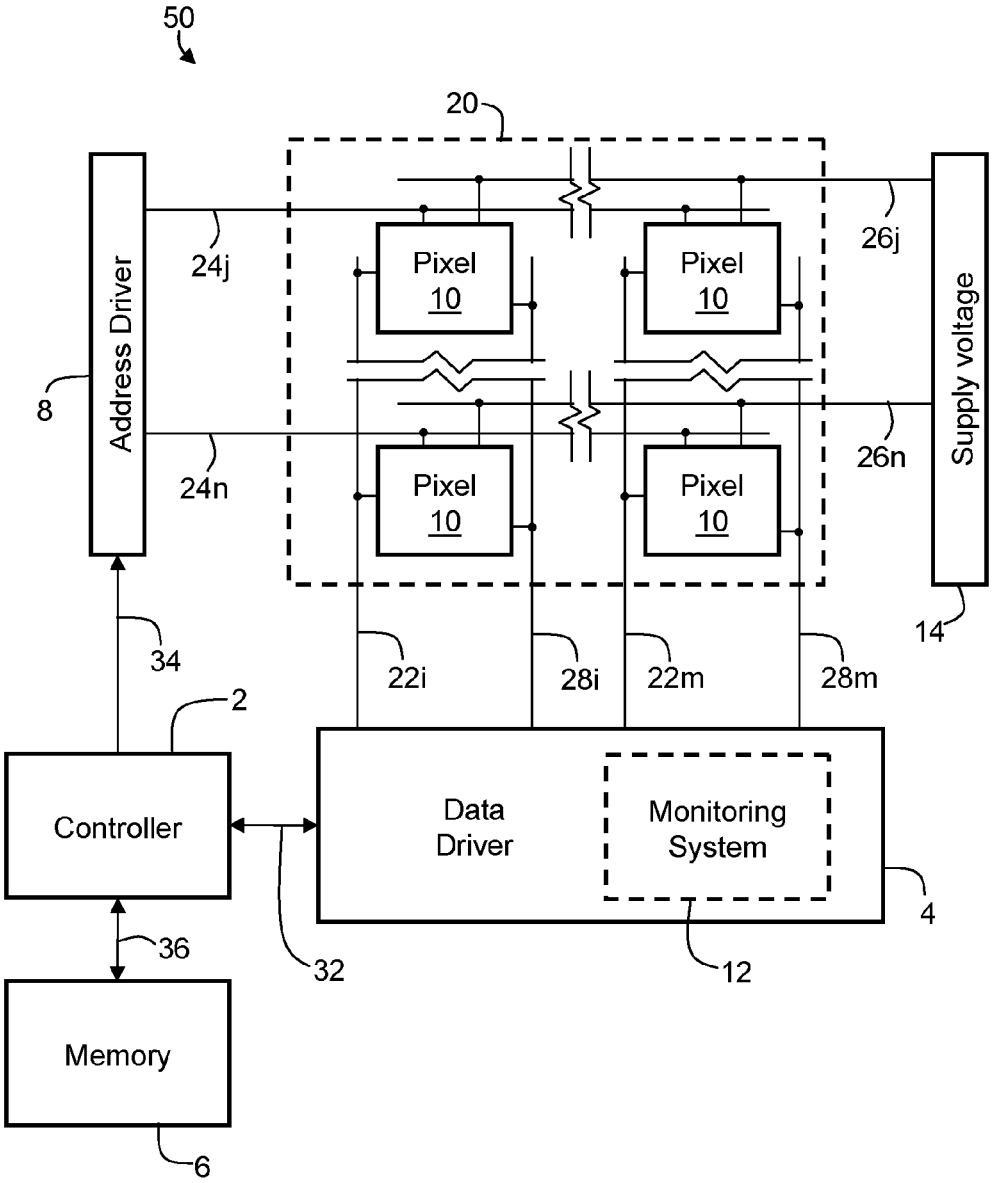
FIG. 1 illustrates an exemplary configuration of a system for monitoring a degradation in a pixel and providing compensation therefore.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

FIG. 1 is a diagram of an exemplary display system 50. The display system 50 includes an address driver 8, a data driver 4, a controller 2, a memory storage 6, and display panel 20. The display panel 20 includes an array of pixels 10 arranged in rows and columns. Each of the pixels 10 are individually programmable to emit light with individually programmable luminance values. The controller 2 receives digital data indicative of information to be displayed on the display panel 20. The controller 2 sends signals 32 to the data driver 4 and scheduling signals 34 to the address driver 8 to drive the pixels 10 in the display panel 20 to display the information indicated. The plurality of pixels 10 associated with the display panel 20 thus comprise a display array ("display screen") adapted to dynamically display information according to the input digital data received by the controller 2. The display screen can display, for example, video information from a stream of video data received by the controller 2. The supply voltage 14 can provide a constant power voltage or can be an adjustable voltage supply that is controlled by signals from the controller 2. The display system 50 can also incorporate features from a current source or sink (not shown) to provide biasing currents to the pixels 10 in the display panel 20 to thereby decrease programming time for the pixels 10.

For illustrative purposes, the display system 50 in FIG. 1 is illustrated with only four pixels 10 in the display panel 20. It is understood that the display system 50 can be implemented with a display screen that includes an array of similar pixels, such as the pixels 10, and that the display screen is not limited to a particular number of rows and columns of pixels. For example, the display system 50 can be implemented with a display screen with a number of rows and columns of pixels commonly available in displays for mobile devices, monitor-based devices, and/or projection-devices.

The pixel 10 is operated by a driving circuit ("pixel circuit") that generally includes a driving transistor and a light emitting device. Hereinafter the pixel 10 may refer to the pixel circuit. The light emitting device can optionally be an organic light emitting diode, but implementations of the present disclosure apply to pixel circuits having other electroluminescence devices, including current-driven light emitting devices. The driving transistor in the pixel 10 can optionally be an n-type or p-type amorphous silicon thin-film transistor, but implementations of the present disclosure are not limited to pixel circuits having a particular polarity of transistor or only to pixel circuits having thin-film transistors. The pixel circuit 10 can also include a storage capacitor for storing programming information and allowing the pixel circuit 10 to drive the light emitting device after being addressed. Thus, the display panel 20 can be an active matrix display array.

As illustrated in FIG. 1, the pixel 10 illustrated as the top-left pixel in the display panel 20 is coupled to a select line 24*j*, a supply line 26*j*, a data line 22*i*, and a monitor line 28*i*. In an implementation, the supply voltage 14 can also provide a second supply line to the pixel 10. For example, each pixel can be coupled to a first supply line charged with Vdd and a second supply line coupled with Vss, and the pixel circuits 10 can be situated between the first and second supply lines to facilitate driving current between the two supply lines during an emission phase of the pixel circuit. The top-left pixel 10 in the display panel 20 can correspond a pixel in the display panel in a "jth" row and "ith" column of the display panel 20. Similarly, the top-right pixel 10 in the display panel 20 represents a "jth" row and "mth" column; the bottom-left pixel 10 represents an "nth" row and "ith" column; and the bottom-right pixel 10 represents an "nth" row and "ith" column. Each of the pixels 10 is coupled to appropriate select lines (e.g., the select lines 24*j* and 24*n*), supply lines (e.g., the supply lines 26*j* and 26*n*), data lines (e.g., the data lines 22*i* and 22*m*), and monitor lines (e.g., the monitor lines 28*i* and 28*m*). It is noted that aspects of the present disclosure apply to pixels having additional connections, such as connections to additional select lines, and to pixels having fewer connections, such as pixels lacking a connection to a monitoring line.

With reference to the top-left pixel 10 shown in the display panel 20, the select line 24*j* is provided by the address driver 8, and can be utilized to enable, for example, a programming operation of the pixel 10 by activating a switch or transistor to allow the data line 22*i* to program the pixel 10. The data line 22*i* conveys programming information from the data driver 4 to the pixel 10. For example, the data line 22*i* can be utilized to apply a programming voltage or a programming current to the pixel 10 in order to program the pixel 10 to emit a desired amount of luminance. The programming voltage (or programming current) supplied by the data driver 4 via the data line 22*i* is a voltage (or current) appropriate to cause the pixel 10 to emit light with a desired amount of luminance according to the digital data received by the controller 2. The programming voltage (or programming current) can be applied to the pixel 10 during a programming operation of the pixel 10 so as to charge a storage device within the pixel 10, such as a storage capacitor, thereby enabling the pixel 10 to emit light with the desired amount of luminance during an emission operation following the programming operation. For example, the storage device in the pixel 10 can be charged during a programming operation to apply a voltage to one or more of a gate or a source terminal of the driving transistor during the emission operation, thereby causing the driving transistor to convey the driving current through the light emitting device according to the voltage stored on the storage device.

Generally, in the pixel 10, the driving current that is conveyed through the light emitting device by the driving transistor during the emission operation of the pixel 10 is a current that is supplied by the first supply line 26*j* and is drained to a second supply line (not shown). The first supply line 22*j* and the second supply line are coupled to the voltage supply 14. The first supply line 26*j* can provide a positive supply voltage (e.g., the voltage commonly referred to in circuit design as "Vdd") and the second supply line can provide a negative supply voltage (e.g., the voltage commonly referred to in circuit design as "Vss"). Implementations of the present disclosure can be realized where one or the other of the supply lines (e.g., the supply line 26*j*) are fixed at a ground voltage or at another reference voltage.

The display system 50 also includes a monitoring system 12. With reference again to the top left pixel 10 in the display panel 20, the monitor line 28*i* connects the pixel 10 to the monitoring system 12. The monitoring system 12 can be integrated with the data driver 4, or can be a separate stand-alone system. In particular, the monitoring system 12 can optionally be implemented by monitoring the current and/or voltage of the data line 22*i* during a monitoring operation of the pixel 10, and the monitor line 28*i* can be entirely omitted. Additionally, the display system 50 can be implemented without the monitoring system 12 or the monitor line 28*i*. The monitor line 28*i* allows the monitoring system 12 to measure a current or voltage associated with the pixel 10 and thereby extract information indicative of a degradation of the pixel 10. For example, the monitoring system 12 can extract, via the monitor line 28*i*, a current flowing through the driving transistor within the pixel 10 and thereby determine, based on the measured current and based on the voltages applied to the driving transistor during the measurement, a threshold voltage of the driving transistor or a shift thereof.

The monitoring system 12 can also extract an operating voltage of the light emitting device (e.g., a voltage drop across the light emitting device while the light emitting device is operating to emit light). The monitoring system 12 can then communicate the signals 32 to the controller 2 and/or the memory 6 to allow the display system 50 to store the extracted degradation information in the memory 6. During subsequent programming and/or emission operations of the pixel 10, the degradation information is retrieved from the memory 6 by the controller 2 via the memory signals 36, and the controller 2 then compensates for the extracted degradation information in subsequent programming and/or emission operations of the pixel 10. For example, once the degradation information is extracted, the programming information conveyed to the pixel 10 via the data line 22*i* can be appropriately adjusted during a subsequent programming operation of the pixel 10 such that the pixel 10 emits light with a desired amount of luminance that is independent of the degradation of the pixel 10. In an example, an increase in the threshold voltage of the driving transistor within the pixel 10 can be compensated for by appropriately increasing the programming voltage applied to the pixel 10.

Figure 2A:
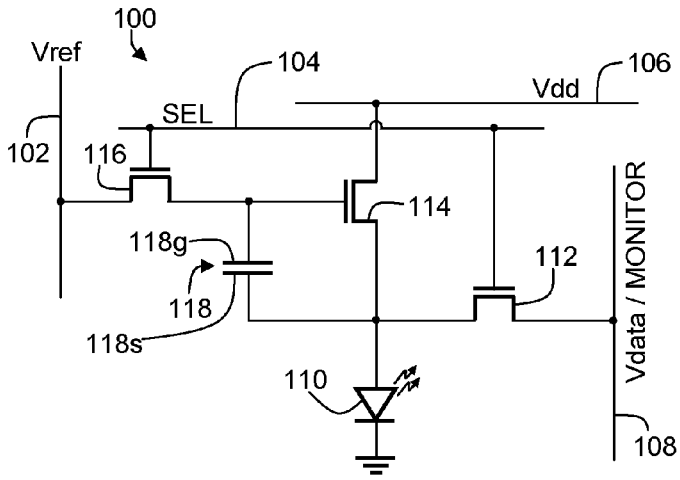
FIG. 2A is a circuit diagram of an exemplary driving circuit for a pixel.

FIG. 2A is a circuit diagram of an exemplary driving circuit for a pixel 100. The driving circuit shown in FIG. 1A is utilized to program, monitor, and drive the pixel 100 and includes a driving transistor 114 for conveying a driving current through an organic light emitting diode ("OLED") 110. The OLED 110 emits light according to the current passing through the OLED 110, and can be replaced by any current-driven light emitting device. The pixel 100 can be utilized in the display panel 20 of the display system 50 described in connection with FIG. 1.

The driving circuit for the pixel 100 also includes a storage capacitor 118, a switching transistor 116, and a data switching transistor 112. The pixel 100 is coupled to a reference voltage line 102, a select line 104, a voltage supply line 106, and a data/monitor line 108. The driving transistor 114 draws a current from the voltage supply line 106 according to a gate-source voltage ("Vgs") across a gate terminal of the driving transistor 114 and a source terminal of the driving transistor 114. For example, in a saturation mode of the driving transistor 114, the current passing through the driving transistor can be given by $Ids=\beta(Vgs-Vt)^2$, where β is a parameter that depends on device characteristics of the driving transistor 114, Ids is the current from the drain terminal of the driving transistor 114 to the source terminal of the driving transistor 114, and Vt is a threshold voltage of the driving transistor 114.

In the pixel 100, the storage capacitor 118 is coupled across the gate terminal and the source terminal of the driving transistor 114. The storage capacitor 118 has a first terminal 118*g*, which is referred to for convenience as a gate-side terminal 118*g*, and a second terminal 118*s*, which is referred to for convenience as a source-side terminal 118*s*. The gate-side terminal 118*g* of the storage capacitor 118 is electrically coupled to the gate terminal of the driving transistor 114. The source-side terminal 118*s* of the storage capacitor 118 is electrically coupled to the source terminal of the driving transistor 114. Thus, the gate-source voltage Vgs of the driving transistor 114 is also the voltage charged on the storage capacitor 118. As will be explained further below, the storage capacitor 118 can thereby maintain a driving voltage across the driving transistor 114 during an emission phase of the pixel 100.

The drain terminal of the driving transistor 114 is electrically coupled to the voltage supply line 106. The source terminal of the driving transistor 114 is electrically coupled to an anode terminal of the OLED 110. A cathode terminal of the OLED 110 can be connected to ground or can optionally be connected to a second voltage supply line, such as a supply line Vss. Thus, the OLED 110 is connected in series with the current path of the driving transistor 114. The OLED 110 emits light according to the current passing through the OLED 110 once a voltage drop across the anode and cathode terminals of the OLED achieves an operating voltage ("$V_{OLED}$") of the OLED 110. That is, when the difference between the voltage on the anode terminal and the voltage on the cathode terminal is greater than the operating voltage $V_{OLED}$, the OLED 110 turns on and emits light. When the anode to cathode voltage is less than $V_{OLED}$, current does not pass through the OLED 110.

The switching transistor 116 is operated according to a select line 104 (e.g., when the select line 104 is at a high level, the switching transistor 116 is turned on, and when the select line 104 is at a low level, the switching transistor is turned off). When turned on, the switching transistor 116 electrically couples the gate terminal of the driving transistor (and the gate-side terminal 118*g* of the storage capacitor 118) to the reference voltage line 102. As will be described further below in connection with FIG. 1B, the reference voltage line 102 can be maintained at a ground voltage or another fixed reference voltage ("Vref") and can optionally be adjusted during a programming phase of the pixel 100 to provide compensation for degradation of the pixel 100. The data switching transistor 112 is operated by the select line 104 in the same manner as the switching transistor 116. Although, it is noted that the data switching transistor 112 can optionally be operated by a second select line in an implementation of the pixel 100. When turned on, the data switching transistor 112 electrically couples the source terminal of the driving transistor (and the source-side terminal 118*s* of the storage capacitor 118) to the data/monitor line 108.

Figure 2B:
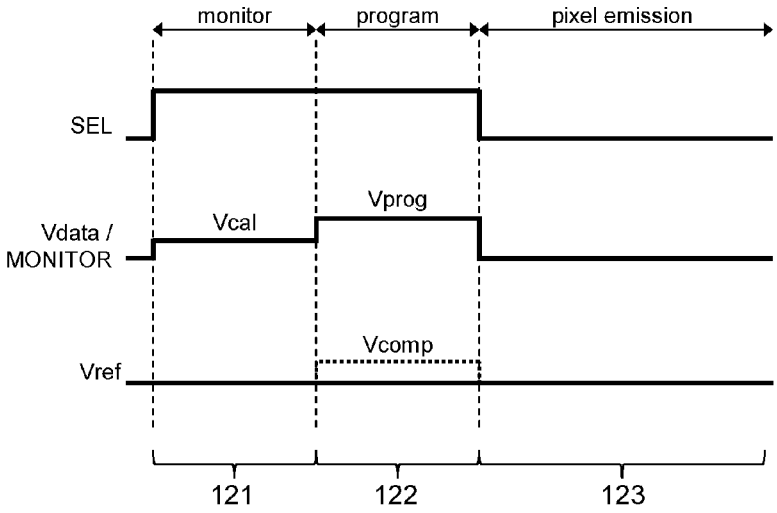
FIG. 2B is a schematic timing diagram of exemplary operation cycles for the pixel shown in FIG. 2A.

FIG. 2B is a schematic timing diagram of exemplary operation cycles for the pixel 100 shown in FIG. 2A. The pixel 100 can be operated in a monitor phase 121, a program phase 122, and an emission phase 123. During the monitor phase 121, the select line 104 is high and the switching transistor 116 and the data switching transistor 112 are both turned on. The data/monitor line 108 is fixed at a calibration voltage ("Vcal"). Because the data switching transistor 112 is turned on, the calibration voltage Vcal is applied to the anode terminal of the OLED 110. The value of Vcal is chosen such that the voltage applied across the anode and cathode terminals of the OLED 110 is less than the operating voltage $V_{OLED}$ of the OLED 110, and the OLED 110 therefore does not draw current. By setting Vcal at a level sufficient to turn off the OLED 110 (i.e., sufficient to ensure that the OLED 110 does not draw current), the current flowing through the driving transistor 114 during the monitor phase 121 does not pass through the OLED 110 and instead travels through the data/monitor line 108. Thus, by fixing the data/monitor line 108 at Vcal during the monitor phase 121, the current on the data/monitor line 108 is the current being drawn through the driving transistor 114. The data/monitor line 108 can then be coupled to a monitoring system (such as the monitoring system 12 shown in FIG. 1) to measure the current during the monitor phase 121 and thereby extract information indicative of a degradation of the pixel 100. For example, by analyzing the current measured on the data/monitor line 108 during the monitor phase 121 with a reference current value, the threshold voltage ("Vt") of the driving transistor can be determined. Such a determination of the threshold voltage can be carried out by comparing the measured current with an expected current based on the values of the reference voltage Vref and the calibration voltage Vcal applied to the gate and source terminals, respectively, of the driving transistor 114. For example, the relationship $$Imeas=Ids=\beta(Vgs-Vt)^2=\beta(Vref-Vcal-Vt)^2$$

can be rearranged to yield $$Vt=Vref-Vcal-(Imeas/\beta)^{1/2}$$

Additionally or alternatively, degradation of the pixel 100 (e.g., the value of Vt) can be extracted according to a stepwise method wherein a comparison is made between Imeas and an expected current and an estimate of the value of Imeas is updated incrementally according to the comparison (e.g., based on determining whether Imeas is lesser than, or greater than, the expected current). It is noted that while the above description describes measuring the current on the data/monitor line 108 during the monitor phase 121, the monitor phase 121 can include measuring a voltage on the data/monitor line 108 while fixing the current on the data/monitor line 108. Furthermore, the monitor phase 121 can include indirectly measuring the current on the data/monitor line 108 by, for example, measuring a voltage drop across a load, measuring a current related to the current on the data/monitor line 108 provided via a current conveyor, or by measuring a voltage output from a current controlled voltage source that receives the current on the data/monitor line 108.

During the programming phase 122, the select line 104 remains high, and the switching transistor 116 and the data switching transistor 112 therefore remain turned on. The reference voltage line 102 can remain fixed at Vref or can optionally be adjusted by a compensation voltage ("Vcomp") appropriate to account for degradation of the pixel 100, such as the degradation determined during the monitor phase 121. For example, Vcomp can be a voltage sufficient to account for a shift in the threshold voltage Vt of the driving transistor 114. The voltage Vref (or Vcomp) is applied to the gate-side terminal 118*g* of the storage capacitor 118. Also during the program phase 122, the data/monitor line 108 is adjusted to a programming voltage ("Vprog"), which is applied to the source-side terminal 118*s* of the storage capacitor 118. During the program phase 122, the storage capacitor 118 is charged with a voltage given by the difference of Vref (or Vcomp) on the reference voltage line 102 and Vprog on the data/monitor line 108.

According to an aspect of the present disclosure, degradation of the pixel 100 is compensated for by applying the compensation voltage Vcomp to the gate-side terminal 118*g* of the storage capacitor 118 during the program phase 122. As the pixel 100 degrades due to, for example, mechanical stresses, aging, temperature variations, etc. the threshold voltage Vt of the driving transistor 114 can shift (e.g., increase) and therefore a larger gate-source voltage Vgs is required across the driving transistor 114 to maintain a desired driving current through the OLED 110. In implementations, the shift in Vt can first be measured, during the monitor phase 121, via the data/monitor line 108, and then the shift in Vt can be compensated for, during the program phase 122, by applying a compensation voltage Vcomp separate from a programming voltage Vprog to the gate-side terminal 118*g* of the storage capacitor 118. Additionally or alternatively, compensation can be provided via adjustments to the programming voltage Vprog applied to the source-side terminal 118*s* of the storage capacitor 118. Furthermore, the programming voltage Vprog is preferably a voltage sufficient to turn off the OLED 110 during the program phase 122 such that the OLED 110 is prevented from emitting light during the program phase 122.

During the emission phase 123 of the pixel 100, the select line 104 is low, and the switching transistor 116 and the data switching transistor 112 are both turned off. The storage capacitor 118 remains charged with the driving voltage given by the difference of Vref (or Vcomp) and Vprog applied across the storage capacitor 118 during the program phase 122. After the switching transistor 116 and the data switching transistor 112 are turned off, the storage capacitor 118 maintains the driving voltage and the driving transistor 114 draws a driving current from the voltage supply line 106. The driving current is then conveyed through the OLED 110 which emits light according to the amount of current passed through the OLED 110. During the emission phase 123, the anode terminal of the OLED 110 (and the source-side terminal 118*s* of the storage capacitor) can change from the program voltage Vprog applied during the program phase 122 to an operating voltage $V_{OLED}$ of the OLED 110. Furthermore, as the driving current is passed through the OLED 110, the anode terminal of the OLED 110 can change (e.g., increase) over the course of the emission phase 123. However, during the emission phase 123, the storage capacitor 118 self-adjusts the voltage on the gate terminal of the driving transistor 114 to maintain the gate-source voltage of the driving transistor 114 even as the voltage on the anode of the OLED 110 may change. For example, adjustments (e.g., increases) on the source-side terminal 118*s* are reflected on the gate-side terminal 118*g* so as to maintain the driving voltage that was charged on the storage capacitor 118 during the program phase 122.

While the driving circuit illustrated in FIG. 2A is illustrated with n-type transistors, which can be thin-film transistors and can be formed from amorphous silicon, the driving circuit illustrated in FIG. 2A and the operating cycles illustrated in FIG. 2B can be extended to a complementary circuit having one or more p-type transistors and having transistors other than thin film transistors.

Figure 3A:
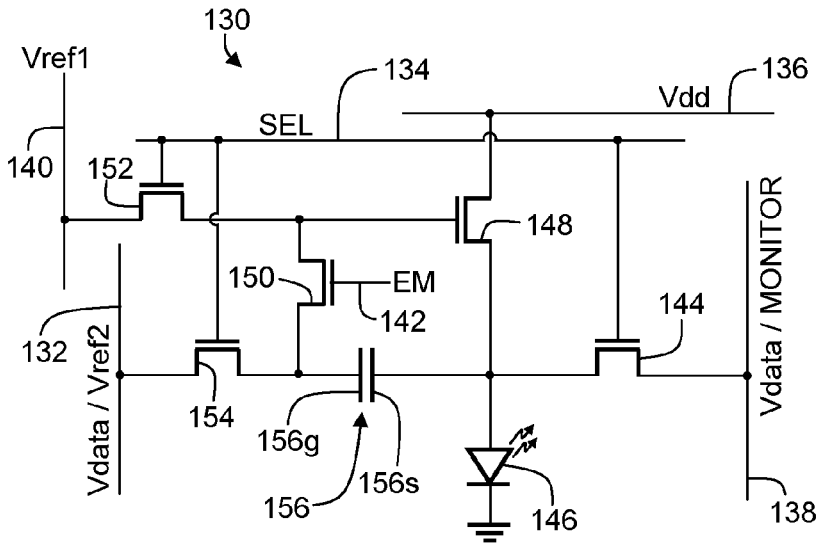
FIG. 3A is a circuit diagram for an exemplary pixel circuit configuration for a pixel.

FIG. 3A is a circuit diagram for an exemplary pixel circuit configuration for a pixel 130. The driving circuit for the pixel 130 is utilized to program, monitor, and drive the pixel 130. The pixel 130 includes a driving transistor 148 for conveying a driving current through an OLED 146. The OLED 146 is similar to the OLED 110 shown in FIG. 2A and emits light according to the current passing through the OLED 146. The OLED 146 can be replaced by any current-driven light emitting device. The pixel 130 can be utilized in the display panel 20 of the display system 50 described in connection with FIG. 1, with appropriate modifications to include the connection lines described in connection with the pixel 130.

The driving circuit for the pixel 130 also includes a storage capacitor 156, a first switching transistor 152, and a second switching transistor 154, a data switching transistor 144, and an emission transistor 150. The pixel 130 is coupled to a reference voltage line 140, a data/reference line 132, a voltage supply line 136, a data/monitor line 138, a select line 134, and an emission line 142. The driving transistor 148 draws a current from the voltage supply line 136 according to a gate-source voltage ("Vgs") across a gate terminal of the driving transistor 148 and a source terminal of the driving transistor 148, and a threshold voltage ("Vt") of the driving transistor 148. The relationship between the drain-source current and the gate-source voltage of the driving transistor 148 is similar to the operation of the driving transistor 114 described in connection with FIGS. 2A and 2B.

In the pixel 130, the storage capacitor 156 is coupled across the gate terminal and the source terminal of the driving transistor 148 through the emission transistor 150. The storage capacitor 156 has a first terminal 156*g*, which is referred to for convenience as a gate-side terminal 156*g*, and a second terminal 156*s*, which is referred to for convenience as a source-side terminal 156*s*. The gate-side terminal 156*g* of the storage capacitor 156 is electrically coupled to the gate terminal of the driving transistor 148 through the emission transistor 150. The source-side terminal 156*s* of the storage capacitor 156 is electrically coupled to the source terminal of the driving transistor 148. Thus, when the emission transistor 150 is turned on, the gate-source voltage Vgs of the driving transistor 148 is the voltage charged on the storage capacitor 156. The emission transistor 150 is operated according to the emission line 142 (e.g., the emission transistor 150 is turned on when the emission line 142 is set high and vice versa). As will be explained further below, the storage capacitor 156 can thereby maintain a driving voltage across the driving transistor 148 during an emission phase of the pixel 130.

The drain terminal of the driving transistor 148 is electrically coupled to the voltage supply line 136. The source terminal of the driving transistor 148 is electrically coupled to an anode terminal of the OLED 146. A cathode terminal of the OLED 146 can be connected to ground or can optionally be connected to a second voltage supply line, such as a supply line Vss. Thus, the OLED 146 is connected in series with the current path of the driving transistor 148. The OLED 146 emits light according to the current passing through the OLED 146 once a voltage drop across the anode and cathode terminals of the OLED 146 achieves an operating voltage ("$V_{OLED}$") of the OLED 146 similar to the description of the OLED 110 provided in connection with FIGS. 2A and 2B.

The first switching transistor 152, the second switching transistor 154, and the data switching transistor 144 are each operated according to the select line 134 (e.g., when the select line 134 is at a high level, the transistors 144, 152, 154 are turned on, and when the select line 134 is at a low level, the switching transistors 144, 152, 154 are turned off). When turned on, the first switching transistor 152 electrically couples the gate terminal of the driving transistor 148 to the reference voltage line 140. As will be described further below in connection with FIG. 3B, the reference voltage line 140 can be maintained at a fixed first reference voltage ("Vref1"). The data switching transistor 144 and/or the second switching transistor 154 can optionally be operated by a second select line in an implementation of the pixel 130. When turned on, the second switching transistor 154 electrically couples the gate-side terminal 156*g* of the storage capacitor 156 to the data/reference line 132. When turned on, the data switching transistor 144 electrically couples the data/monitor line 138 to the source-side terminal 156*s* of the storage capacitor 156.

Figure 3B:
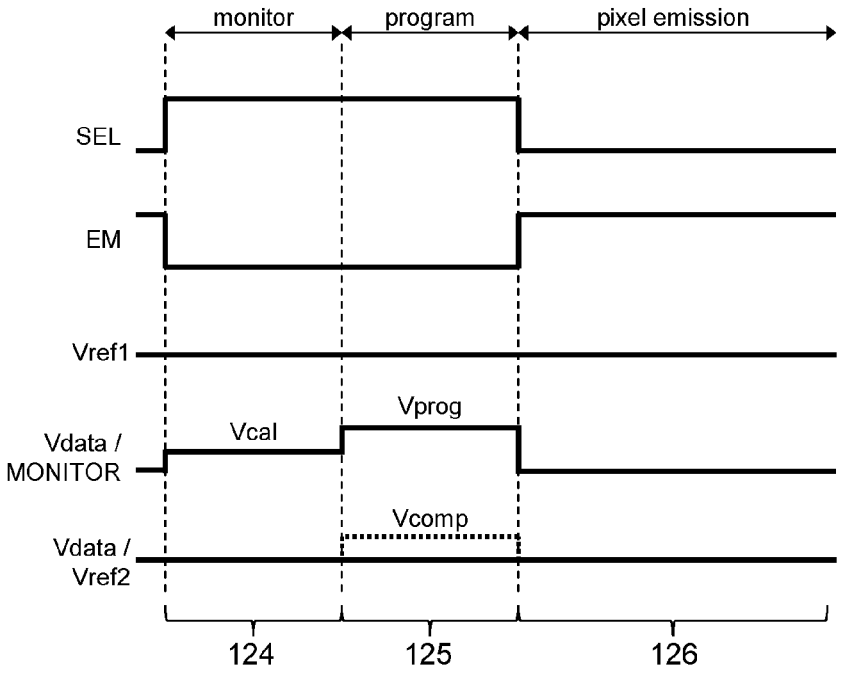
FIG. 3B is a timing diagram for operating the pixel illustrated in FIG. 3A.

FIG. 3B is a timing diagram for operating the pixel 130 illustrated in FIG. 3A. As shown in FIG. 3B, the pixel 130 can be operated in a monitor phase 124, a program phase 125, and an emission phase 126.

During the monitor phase 124 of the pixel 130, the select line 134 is set high while the emission line 142 is set low. The first switching transistor 152, the second switching transistor 154, and the data switching transistor 144 are all turned on while the emission transistor 150 is turned off. The data/monitor line 138 is fixed at a calibration voltage ("Vcal"), and the reference voltage line 140 is fixed at the first reference voltage Vref1. The reference voltage line 140 applies the first reference voltage Vref1 to the gate terminal of the driving transistor 148 through the first switching transistor 152, and the data/monitor line 138 applies the calibration voltage Vcal to the source terminal of the driving transistor 148 through the data switching transistor 144. The first reference voltage Vref1 and the calibration voltage Vcal thus fix the gate-source potential Vgs of the driving transistor 148. The driving transistor 148 draws a current from the voltage supply line 136 according to the gate-source potential difference thus defined. The calibration voltage Vcal is also applied to the anode of the OLED 146 and is advantageously selected to be a voltage sufficient to turn off the OLED 146. For example, the calibration voltage Vcal can cause the voltage drop across the anode and cathode terminals of the OLED 146 to be less than the operating voltage $V_{OLED}$ of the OLED 146. By turning off the OLED 146, the current through the driving transistor 148 is directed entirely to the data/monitor line 138 rather than through the OLED 146. Similar to the description of the monitoring phase 121 in connection with the pixel 100 in FIGS. 2A and 2B, the current measured on the data/monitor line 138 of the pixel 130 can be used to extract degradation information for the pixel 130, such as information indicative of the threshold voltage Vt of the driving transistor 148.

During the program phase 125, the select line 134 is set high and the emission line 142 is set low. Similar to the monitor phase 124, the first switching transistor 152, the second switching transistor 154, and the data switching transistor 144 are all turned on while the emission transistor 150 is turned off. The data/monitor line 138 is set to a program voltage ("Vprog"), the reference voltage line 140 is fixed at the first reference voltage Vref1, and the data/reference line 132 is set to a second reference voltage ("Vref2"). During the program phase 125, the second reference voltage Vref2 is thus applied to the gate-side terminal 156*g* of the storage capacitor 156 while the program voltage Vprog is applied to the source-side terminal 156*s* of the storage capacitor 156. In an implementation, the data/reference line 132 can be set (adjusted) to a compensation voltage ("Vcomp") rather than remain fixed at the second reference voltage Vref2 during the program phase 125. The storage capacitor 156 is then charged according to the difference between the second reference voltage Vref2 (or the compensation voltage Vcomp) and the program voltage Vprog. Implementations of the present disclosure also include operations of the program phase 125 where the program voltage Vprog is applied to the data/reference line 132, while the data/monitor line 138 is fixed at a second reference voltage Vref2, or at a compensation voltage Vcomp. In either operation, the storage capacitor 156 is charged with a voltage given by the difference of Vprog and Vref2 (or Vcomp). Similar to the operation of the pixel 100 described in connection with FIGS. 2A and 2B, the compensation voltage Vcomp applied to the gate-side terminal 156*g* is a proper voltage to account for a degradation of the pixel circuit 130, such as the degradation measured during the monitor phase 124 (e.g., an increase in the threshold voltage Vt of the driving transistor 148).

The program voltage Vprog is applied to the anode terminal of the OLED 146 during the program phase 125. The program voltage Vprog is advantageously selected to be sufficient to turn off the OLED 146 during the program phase 125. For example, the program voltage Vprog can advantageously cause the voltage drop across the anode and cathode terminals of the OLED 146 to be less than the operating voltage $V_{OLED}$ of the OLED 146. Additionally or alternatively, in implementations where the second reference voltage Vref2 is applied to the data/monitor line 138, the second reference voltage Vref2 can be selected to be a voltage that maintains the OLED 146 in an off state.

During the program phase 125, the driving transistor 148 is advantageously isolated from the storage capacitor 156 while the storage capacitor 156 receives the programming information via the data/reference line 132 and/or the data/monitor line 138. By isolating the driving transistor 148 from the storage capacitor 156 with the emission transistor 150, which is turned off during the program phase 125, the driving transistor 148 is advantageously prevented from turning on during the program phase 125. The pixel circuit 100 in FIG. 2A provides an example of a circuit lacking a means to isolate the driving transistor 114 from the storage capacitor 118 during the program phase 122. By way of example, in the pixel 100, during the program phase 122, a voltage is established across the storage capacitor sufficient to turn on the driving transistor 114. Once the voltage on the storage capacitor 118 is sufficient, the driving transistor 114 begins drawing current from the voltage supply line 106. The current does not flow through the OLED 110, which is reverse biased during the program phase 122, instead the current from the driving transistor 114 flows through the data switching transistor 112. A voltage drop is therefore developed across the data switching transistor 112 due to the non-zero resistance of the data switching transistor 112 as the current is conveyed through the data switching transistor 112. The voltage drop across the data switching transistor 112 causes the voltage that is applied to the source-side terminal 118*s* of the storage capacitor 118 to be different from the program voltage Vprog on the data/monitor line 108. The difference is given by the current flowing through the data switching transistor 112 and the inherent resistance of the data switching transistor 112.

Referring again to FIGS. 3A and 3B, the emission transistor 150 of the pixel 130 addresses the above-described effect by ensuring that the voltage established on the storage capacitor 156 during the program phase 125 is not applied across the gate-source terminals of the driving transistor 148 during the program phase 125. The emission transistor 150 disconnects one of the terminals of the storage capacitor 156 from the driving transistor 148 to ensure that the driving transistor is not turned on during the program phase 125 of the pixel 130. The emission transistor 150 allows for programming the pixel circuit 130 (e.g., charging the storage capacitor 156) with a voltage that is independent of a resistance of the switching transistor 144. Furthermore, the first reference voltage Vref1 applied to the reference voltage line 140 can be selected such that the gate-source voltage given by the difference between Vref1 and Vprog is sufficient to prevent the driving transistor 148 from switching on during the program phase 125.

During the emission phase 126 of the pixel 130, the select line 134 is set low while the emission line 142 is high. The first switching transistor 152, the second switching transistor 154, and the data switching transistor 144 are all turned off. The emission transistor 150 is turned on during the emission phase 126. By turning on the emission transistor 150, the storage capacitor 156 is connected across the gate terminal and the source terminal of the driving transistor 148. The driving transistor 148 draws a driving current from the voltage supply line 136 according to driving voltage stored on the storage capacitor 156 and applied across the gate and source terminals of the driving transistor 148. The anode terminal of the OLED 146 is no longer set to a program voltage by the data/monitor line 138 because the data switching transistor 144 is turned off, and so the OLED 146 is turned on and the voltage at the anode terminal of the OLED 146 adjusts to the operating voltage $V_{OLED}$ of the OLED 146. The storage capacitor 156 maintains the driving voltage charged on the storage capacitor 156 by self-adjusting the voltage of the source terminal and/or gate terminal of the driving transistor 148 so as to account for variations on one or the other. For example, if the voltage on the source-side terminal 156*s* changes during the emission cycle 126 due to, for example, the anode terminal of the OLED 146 settling at the operating voltage $V_{OLED}$, the storage capacitor 156 adjusts the voltage on the gate terminal of the driving transistor 148 to maintain the driving voltage across the gate and source terminals of the driving transistor 148.

While the driving circuit illustrated in FIG. 3A is illustrated with n-type transistors, which can be thin-film transistors and can be formed from amorphous silicon, the driving circuit illustrated in FIG. 3A for the pixel 130 and the operating cycles illustrated in FIG. 3B can be extended to a complementary circuit having one or more p-type transistors and having transistors other than thin film transistors.

Figure 4A:
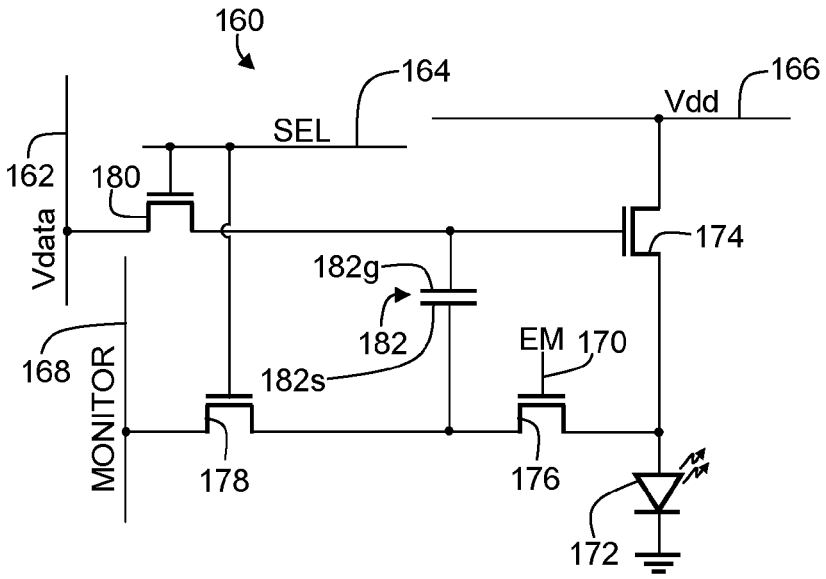
FIG. 4A is a circuit diagram for an exemplary pixel circuit configuration for a pixel.

FIG. 4A is a circuit diagram for an exemplary pixel circuit configuration for a pixel 160. The driving circuit for the pixel 160 is utilized to program, monitor, and drive the pixel 160. The pixel 160 includes a driving transistor 174 for conveying a driving current through an OLED 172. The OLED 172 is similar to the OLED 110 shown in FIG. 1A and emits light according to the current passing through the OLED 172. The OLED 172 can be replaced by any current-driven light emitting device. The pixel 160 can be utilized in the display panel 20 of the display system 50 described in connection with FIG. 1, with appropriate connection lines to the data driver, address driver, etc.

The driving circuit for the pixel 160 also includes a storage capacitor 182, a data switching transistor 180, a monitor transistor 178, and an emission transistor 176. The pixel 160 is coupled to a data line 162, a voltage supply line 166, a monitor line 168, a select line 164, and an emission line 170. The driving transistor 174 draws a current from the voltage supply line 166 according to a gate-source voltage ("Vgs") across a gate terminal of the driving transistor 174 and a source terminal of the driving transistor 174, and a threshold voltage ("Vt") of the driving transistor 174. The relationship between the drain-source current and the gate-source voltage of the driving transistor 174 is similar to the operation of the driving transistor 114 described in connection with FIGS. 2A and 2B.

In the pixel 160, the storage capacitor 182 is coupled across the gate terminal and the source terminal of the driving transistor 174 through the emission transistor 176. The storage capacitor 182 has a first terminal 182*g*, which is referred to for convenience as a gate-side terminal 182*g*, and a second terminal 182*s*, which is referred to for convenience as a source-side terminal 182*s*. The gate-side terminal 182*g* of the storage capacitor 182 is electrically coupled to the gate terminal of the driving transistor 174. The source-side terminal 182*s* of the storage capacitor 182 is electrically coupled to the source terminal of the driving transistor 174 through the emission transistor 176. Thus, when the emission transistor 176 is turned on, the gate-source voltage Vgs of the driving transistor 174 is the voltage charged on the storage capacitor 182. The emission transistor 176 is operated according to the emission line 170 (e.g., the emission transistor 176 is turned on when the emission line 170 is set high and vice versa). As will be explained further below, the storage capacitor 182 can thereby maintain a driving voltage across the driving transistor 174 during an emission phase of the pixel 160.

The drain terminal of the driving transistor 174 is electrically coupled to the voltage supply line 166. The source terminal of the driving transistor 174 is electrically coupled to an anode terminal of the OLED 172. A cathode terminal of the OLED 172 can be connected to ground or can optionally be connected to a second voltage supply line, such as a supply line Vss. Thus, the OLED 172 is connected in series with the current path of the driving transistor 174. The OLED 172 emits light according to the current passing through the OLED 172 once a voltage drop across the anode and cathode terminals of the OLED 172 achieves an operating voltage ("$V_{OLED}$") of the OLED 172 similar to the description of the OLED 110 provided in connection with FIGS. 2A and 2B.

The data switching transistor 180 and the monitor transistor 178 are each operated according to the select line 168 (e.g., when the select line 168 is at a high level, the transistors 178, 180 are turned on, and when the select line 168 is at a low level, the transistors 178, 180 are turned off). When turned on, the data switching transistor 180 electrically couples the gate terminal of the driving transistor 174 to the data line 162. The data switching transistor 180 and/or the monitor transistor 178 can optionally be operated by a second select line in an implementation of the pixel 160. When turned on, the monitor transistor 178 electrically couples the source-side terminal 182*s* of the storage capacitor 182 to the monitor line 164. When turned on, the data switching transistor 180 electrically couples the data line 162 to the gate-side terminal 182*g* of the storage capacitor 182.

Figure 4B:
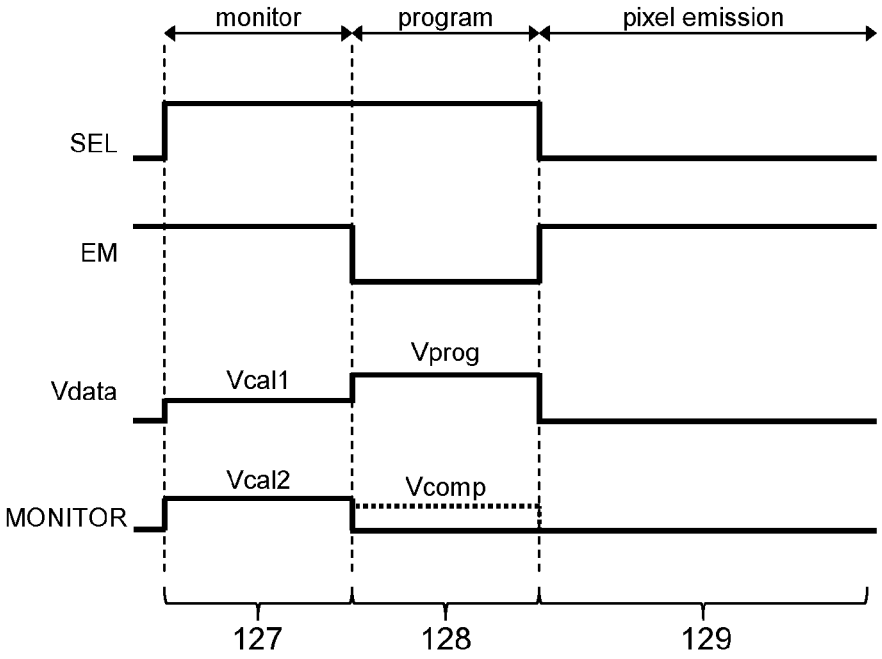
FIG. 4B is a timing diagram for operating the pixel illustrated in FIG. 4A.

FIG. 4B is a timing diagram for operating the pixel 160 illustrated in FIG. 4A. As shown in FIG. 4B, the pixel 160 can be operated in a monitor phase 127, a program phase 128, and an emission phase 129.

During the monitor phase 127 of the pixel 160, the select line 164 and the emission line 170 are both set high. The data switching transistor 180, the monitor transistor 178, and the emission transistor 170 are all turned on. The data line 162 is fixed at a first calibration voltage ("Vcal1"), and the monitor line 168 is fixed at a second calibration voltage ("Vcal2"). The first calibration voltage Vcal1 is applied to the gate terminal of the driving transistor 174 through the data switching transistor 180. The second calibration voltage Vcal2 is applied to the source terminal of the driving transistor 174 through the monitor transistor 178 and the emission transistor 176. The first calibration voltage Vcal1 and the second calibration voltage Vcal2 thereby fix the gate-source potential Vgs of the driving transistor 174 and the driving transistor 174 draws a current from the voltage supply line 166 according to its gate-source potential Vgs. The second calibration voltage Vcal2 is also applied to the anode of the OLED 172 and is advantageously selected to be a voltage sufficient to turn off the OLED 172. Turning off the OLED 172 during the monitor phase 127 ensures that the current flowing through the driving transistor 174 does not pass through the OLED 174 and instead is conveyed to the monitor line 168 via the emission transistor 176 and the monitor transistor 178. Similar to the description of the monitoring phase 121 in connection with the pixel 100 in FIGS. 2A and 2B, the current measured on the monitor line 168 can be used to extract degradation information for the pixel 160, such as information indicative of the threshold voltage Vt of the driving transistor 174.

During the program phase 128, the select line 164 is set high and the emission line 170 is set low. The data switching transistor 180 and the monitor transistor 178 are turned on while the emission transistor 176 is turned off. The data line 162 is set to a program voltage ("Vprog") and the monitor line 168 is fixed at a reference voltage ("Vref"). The monitor line 164 can optionally be set to a compensation voltage ("Vcomp") rather than the reference voltage Vref. The gate-side terminal 182*g* of the storage capacitor 182 is set to the program voltage Vprog and the source-side terminal 182*s* is set to the reference voltage Vref (or the compensation voltage Vcomp). The storage capacitor 182 is thereby charged according to the difference between the program voltage Vprog and the reference voltage Vref (or the compensation voltage Vcomp). The voltage charged on the storage capacitor 182 during the program phase 128 is referred to as a driving voltage. The driving voltage is a voltage appropriate to be applied across the driving transistor 174 to generate a desired driving current that will cause the OLED 172 to emit a desired amount of light. Similar to the operation of the pixel 100 in connection with FIGS. 2A and 2B, the compensation voltage Vcomp optionally applied to the source-side terminal 182*s* is a proper voltage to account for a degradation of the pixel circuit 160, such as the degradation measured during the monitor phase 127 (e.g., an increase in the threshold voltage Vt of the driving transistor 174). Additionally or alternatively, compensation for degradation of the pixel 160 can be accounted for by adjustments to the program voltage Vprog applied to the gate-side terminal 182*g*.

During the program phase 128, the driving transistor 174 is isolated from the storage capacitor 182 by the emission transistor 176, which disconnects the source terminal of the driving transistor 174 from the storage capacitor 182 during the program phase 128. Similar, to the description of the operation of the emission transistor 150 in connection with FIGS. 3A and 3B, isolating the driving transistor 174 and the storage capacitor 182 during the program phase 128 advantageously prevents the driving transistor 182 from turning on during the program phase 128. By preventing the driving transistor 174 from turning on, the voltage applied to the storage capacitor 182 during the program phase 128 is advantageously independent of a resistance of the switching transistors as no current is conveyed through the switching transistors. In the configuration in pixel 160, the emission transistor 176 also advantageously disconnects the storage capacitor 182 from the OLED 172 during the program phase 128, which prevents the storage capacitor 182 from being influenced by an internal capacitance of the OLED 172 during the program phase 128.

During the emission phase 129 of the pixel 160, the select line 164 is set low while the emission line 170 is high. The data switching transistor 180 and the monitor transistor 178 are turned off and the emission transistor 176 is turned on during the emission phase 129. By turning on the emission transistor 176, the storage capacitor 182 is connected across the gate terminal and the source terminal of the driving transistor 174. The driving transistor 174 draws a driving current from the voltage supply line 166 according to the driving voltage stored on the storage capacitor 182. The OLED 172 is turned on and the voltage at the anode terminal of the OLED 172 adjusts to the operating voltage $V_{OLED}$ of the OLED 172. The storage capacitor 182 maintains the driving voltage by self-adjusting the voltage of the source terminal and/or gate terminal of the driving transistor 174 so as to account for variations on one or the other. For example, if the voltage on the source-side terminal 182*s* changes during the emission cycle 129 due to, for example, the anode terminal of the OLED 172 settling at the operating voltage $V_{OLED}$, the storage capacitor 182 adjusts the voltage on the gate terminal of the driving transistor 174 to maintain the driving voltage across the gate and source terminals of the driving transistor 174.

While the driving circuit illustrated in FIG. 4A is illustrated with n-type transistors, which can be thin-film transistors and can be formed from amorphous silicon, the driving circuit illustrated in FIG. 4A for the pixel 160 and the operating cycles illustrated in FIG. 4B can be extended to a complementary circuit having one or more p-type transistors and having transistors other than thin film transistors.

Figure 5A:
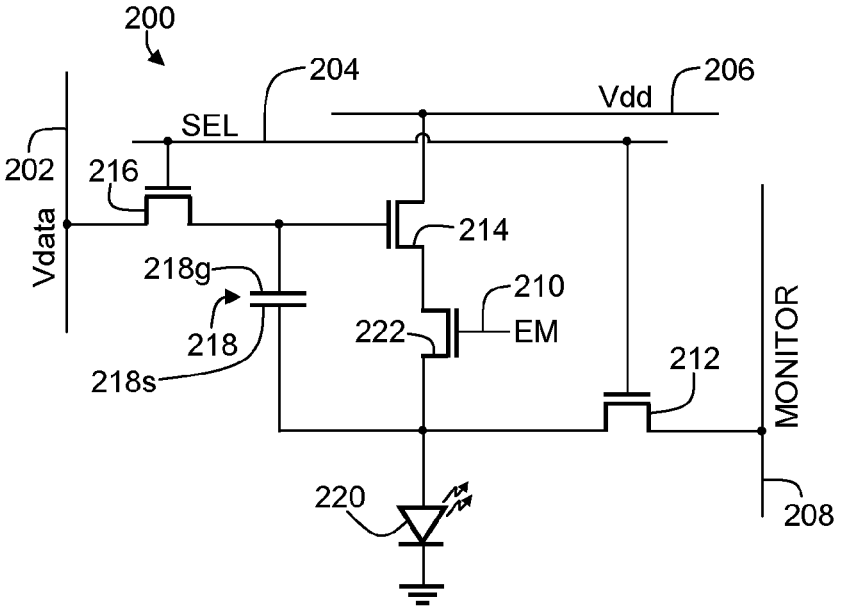
FIG. 5A is a circuit diagram for an exemplary pixel circuit configuration for a pixel.

FIG. 5A is a circuit diagram for an exemplary pixel circuit configuration for a pixel 200. The driving circuit for the pixel 200 is utilized to program, monitor, and drive the pixel 200. The pixel 200 includes a driving transistor 214 for conveying a driving current through an OLED 220. The OLED 220 is similar to the OLED 110 shown in FIG. 2A and emits light according to the current passing through the OLED 220. The OLED 220 can be replaced by any current-driven light emitting device. The pixel 200 can be incorporated into the display panel 20 and the display system 50 described in connection with FIG. 1, with appropriate line connections to the data driver, address driver, monitoring system, etc.

The driving circuit for the pixel 200 also includes a storage capacitor 218, a data switching transistor 216, a monitor transistor 212, and an emission transistor 222. The pixel 200 is coupled to a data line 202, a voltage supply line 206, a monitor line 208, a select line 204, and an emission line 210. The driving transistor 214 draws a current from the voltage supply line 206 according to a gate-source voltage ("Vgs") across a gate terminal of the driving transistor 214 and a source terminal of the driving transistor 214, and a threshold voltage ("Vt") of the driving transistor 214. The relationship between the drain-source current and the gate-source voltage of the driving transistor 214 is similar to the operation of the driving transistor 114 described in connection with FIGS. 2A and 2B.

In the pixel 200, the storage capacitor 218 is coupled across the gate terminal and the source terminal of the driving transistor 214 through the emission transistor 222. The storage capacitor 218 has a first terminal 218*g*, which is referred to for convenience as a gate-side terminal 218*g*, and a second terminal 218*s*, which is referred to for convenience as a source-side terminal 218*s*. The gate-side terminal 218*g* of the storage capacitor 218 is electrically coupled to the gate terminal of the driving transistor 214. The source-side terminal 218*s* of the storage capacitor 218 is electrically coupled to the source terminal of the driving transistor 214 through the emission transistor 222. Thus, when the emission transistor 222 is turned on, the gate-source voltage Vgs of the driving transistor 214 is the voltage charged on the storage capacitor 218. The emission transistor 222 is operated according to the emission line 210 (e.g., the emission transistor 222 is turned on when the emission line 210 is set high and vice versa). As will be explained further below, the storage capacitor 218 can thereby maintain a driving voltage across the driving transistor 214 during an emission phase of the pixel 200.

The drain terminal of the driving transistor 214 is electrically coupled to the voltage supply line 206. The source terminal of the driving transistor 214 is electrically coupled to an anode terminal of the OLED 220 through the emission transistor 222. A cathode terminal of the OLED 220 can be connected to ground or can optionally be connected to a second voltage supply line, such as a supply line Vss. Thus, the OLED 220 is connected in series with the current path of the driving transistor 214. The OLED 220 emits light according to the current passing through the OLED 220 once a voltage drop across the anode and cathode terminals of the OLED 220 achieves an operating voltage ("$V_{OLED}$") of the OLED 220 similar to the description of the OLED 110 provided in connection with FIGS. 2A and 2B.

The data switching transistor 216 and the monitor transistor 212 are each operated according to the select line 204 (e.g., when the select line 204 is at a high level, the transistors 212, 216 are turned on, and when the select line 204 is at a low level, the transistors 212, 216 are turned off). When turned on, the data switching transistor 216 electrically couples the gate terminal of the driving transistor 214 to the data line 202. The data switching transistor 216 and/or the monitor transistor 212 can optionally be operated by a second select line in an implementation of the pixel 200. When turned on, the monitor transistor 212 electrically couples the source-side terminal 218*s* of the storage capacitor 218 to the monitor line 208. When turned on, the data switching transistor 216 electrically couples the data line 202 to the gate-side terminal 218*g* of the storage capacitor 218.

Figure 5B:
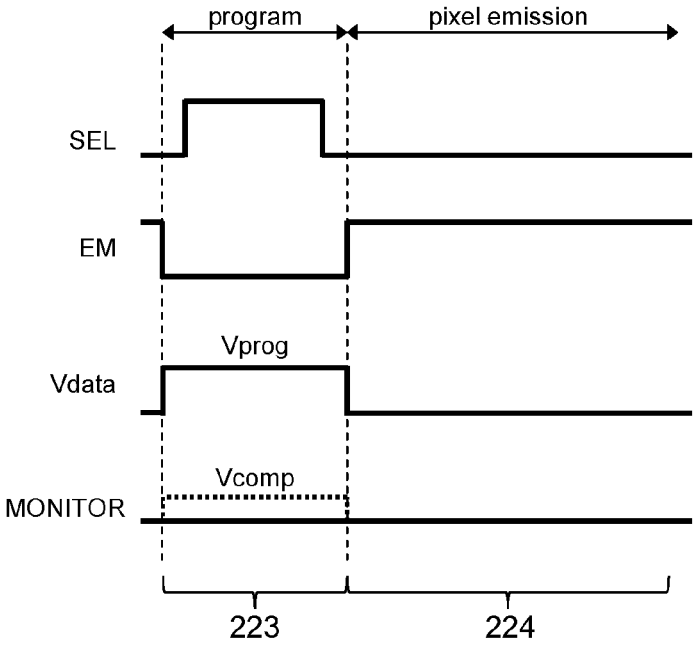
FIG. 5B is a timing diagram for operating the pixel illustrated in FIG. 5A in a program phase and an emission phase.
Figure 5C:
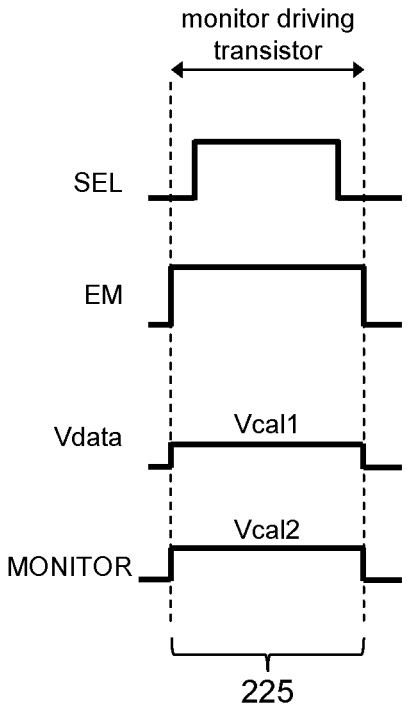
FIG. 5C is a timing diagram for operating the pixel illustrated in FIG. 5A in a TFT monitor phase to measure aspects of the driving transistor.
Figure 5D:
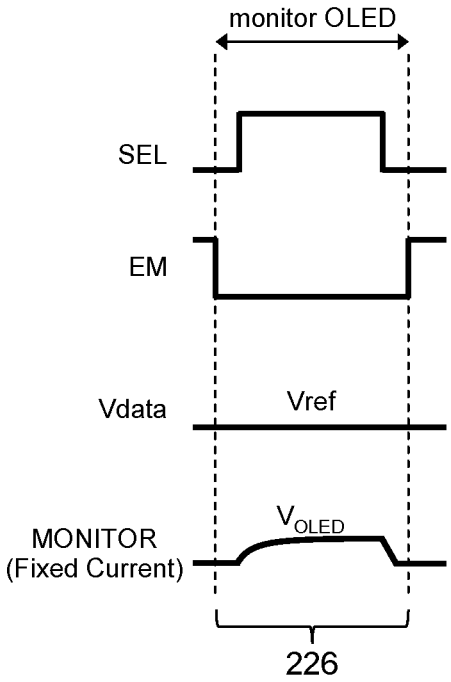
FIG. 5D is a timing diagram for operating the pixel illustrated in FIG. 5A in an OLED monitor phase to measure aspects of the OLED.

FIG. 5B is a timing diagram for operating the pixel 200 illustrated in FIG. 5A in a program phase and an emission phase. As shown in FIG. 5B, the pixel 200 can be operated in a program phase 223, and an emission phase 224. FIG. 5C is a timing diagram for operating the pixel 200 illustrated in FIG. 5A in a TFT monitor phase 225 to measure aspects of the driving transistor 214. FIG. 5D is a timing diagram for operating the pixel 200 illustrated in FIG. 5A in an OLED monitor phase 226 to measure aspects of the OLED 220.

In an exemplary implementation for operating ("driving") the pixel 200, the pixel 200 may be operated with a program phase 223 and an emission phase 224 for each frame of a video display. The pixel 200 may also optionally be operated in either or both of the monitor phases 225, 226 to monitor degradation of the pixel 200 due to the driving transistor 214 or of the OLED 220, or both. The pixel 200 may be operated in the monitor phase(s) 225, 226 intermittently, periodically, or according to a sorting and prioritization algorithm to dynamically determine and identify pixels in a display that require updated degradation information for providing compensation therefore. Therefore, a driving sequence corresponding to a single frame being displayed via the pixel 200 can include the program phase 223 and the emission phase 224, and can optionally either or both of the monitor phases 225, 226.

During the program phase 223, the select line 204 is set high and the emission line 210 is set low. The data switching transistor 216 and the monitor transistor 212 are turned on while the emission transistor 222 is turned off. The data line 202 is set to a program voltage ("Vprog") and the monitor line 208 is fixed at a reference voltage ("Vref"). The monitor line 208 can optionally be set to a compensation voltage ("Vcomp") rather than the reference voltage Vref. The gate-side terminal 218*g* of the storage capacitor 218 is set to the program voltage Vprog and the source-side terminal 218*s* is set to the reference voltage Vref (or the compensation voltage Vcomp). The storage capacitor 218 is thereby charged according to the difference between the program voltage Vprog and the reference voltage Vref (or the compensation voltage Vcomp). The voltage charged on the storage capacitor 218 during the program phase 223 is referred to as a driving voltage. The driving voltage is a voltage appropriate to be applied across the driving transistor to generate a desired driving current that will cause the OLED 220 to emit a desired amount of light. Similar to the operation of the pixel 100 described in connection with FIGS. 2A and 2B, the compensation voltage Vcomp optionally applied to the source-side terminal 218*s* is a proper voltage to account for a degradation of the pixel circuit 200, such as the degradation measured during the monitor phase(s) 225, 226 (e.g., an increase in the threshold voltage Vt of the driving transistor 214). Additionally or alternatively, compensation for degradation of the pixel 200 can be accounted for by adjustments to the program voltage Vprog applied to the gate-side terminal 218*g*.

Furthermore, similar to the pixel 130 described in connection with FIGS. 3A and 3B, the emission transistor 222 ensures that the driving transistor 214 is isolated from the storage capacitor 218 during the program phase 223. By disconnecting the source-side terminal 218*s* of the storage capacitor 218 from the driving transistor 214, the emission transistor 222 ensures that the driving transistor is not turned on during programming such that current flows through a switching transistor. As previously discussed, isolating the driving transistor 214 from the storage capacitor 218 via the emission transistor 222 ensures that the voltage charged on the storage capacitor 218 during the program phase 223 is independent of a resistance of a switching transistor.

During the emission phase 224 of the pixel 200, the select line 204 is set low while the emission line 210 is high. The data switching transistor 216 and the monitor transistor 212 are turned off and the emission transistor 222 is turned on during the emission phase 224. By turning on the emission transistor 214, the storage capacitor 218 is connected across the gate terminal and the source terminal of the driving transistor 214. The driving transistor 214 draws a driving current from the voltage supply line 206 according to the driving voltage stored on the storage capacitor 218. The OLED 220 is turned on and the voltage at the anode terminal of the OLED 220 adjusts to the operating voltage $V_{OLED}$ of the OLED 220. The storage capacitor 218 maintains the driving voltage by self-adjusting the voltage of the source terminal and/or gate terminal of the driving transistor 218 so as to account for variations on one or the other. For example, if the voltage on the source-side terminal 218*s* changes during the emission cycle 224 due to, for example, the anode terminal of the OLED 220 settling at the operating voltage $V_{OLED}$, the storage capacitor 218 adjusts the voltage on the gate terminal of the driving transistor 214 to maintain the driving voltage across the gate and source terminals of the driving transistor 214.

During the TFT monitor phase 225 of the pixel 200, the select line 204 and the emission line 210 are both set high. The data switching transistor 216, the monitor transistor 212, and the emission transistor 222 are all turned on. The data line 202 is fixed at a first calibration voltage ("Vcal1"), and the monitor line 208 is fixed at a second calibration voltage ("Vcal2"). The first calibration voltage Vcal1 is applied to the gate terminal of the driving transistor 214 through the data switching transistor 216. The second calibration voltage Vcal2 is applied to the source terminal of the driving transistor 214 through the monitor transistor 212 and the emission transistor 222. The first calibration voltage Vcal1 and the second calibration voltage Vcal2 thereby fix the gate-source potential Vgs of the driving transistor 214 and the driving transistor 214 draws a current from the voltage supply line 206 according to its gate-source potential Vgs. The second calibration voltage Vcal2 is also applied to the anode of the OLED 220 and is advantageously selected to be a voltage sufficient to turn off the OLED 220. Turning off the OLED 220 during the TFT monitor phase 225 ensures that the current flowing through the driving transistor 214 does not pass through the OLED 220 and instead is conveyed to the monitor line 208 via the emission transistor 222 and the monitor transistor 212. Similar to the description of the monitoring phase 121 in connection with the pixel 100 in FIGS. 2A and 2B, the current measured on the monitor line 208 can be used to extract degradation information for the pixel 200, such as information indicative of the threshold voltage Vt of the driving transistor 214.

During the OLED monitor phase 226 of the pixel 200, the select line 204 is set high while the emission line 210 is set low. The data switching transistor 216 and the monitor transistor 212 are turned on while the emission transistor 222 is turned off. The data line 202 is fixed at a reference voltage Vref, and the monitor line sources or sinks a fixed current on the monitor line 208. The fixed current on the monitor line 208 is applied to the OLED 220 through the monitor transistor 212, and causes the OLED 220 to settle at its operating voltage $V_{OLED}$. Thus, by applying a fixed current to the monitor line 208, and measuring the voltage of the monitor line 208, the operating voltage $V_{OLED}$ of the OLED 220 can be extracted.

It is also note that in FIGS. 5B through 5D, the emission line is generally set to a level within each operating phase for a longer duration than the select line is set to a particular level. By delaying, shortening, or lengthening, the durations of the values held by the select line 204 and/or the emission line 210 during the operating cycles, aspects of the pixel 200 can more accurately settle to stable points prior to subsequent operating cycles. For example, with respect to the program operating cycle 223, setting the emission line 210 low prior to setting the select line 204 high, allows the driving transistor 214 to cease driving current prior to new programming information being applied to the driving transistor via the data switching transistor 216. While this feature of delaying, or providing settling time before and after distinct operating cycles of the pixel 200 is illustrated for the pixel 200, similar modifications can be made to the operating cycles of other circuits disclosed herein, such as the pixels 100, 130, 170, etc.

While the driving circuit illustrated in FIG. 5A is illustrated with n-type transistors, which can be thin-film transistors and can be formed from amorphous silicon, the driving circuit illustrated in FIG. 5A for the pixel 200 and the operating cycles illustrated in FIGS. 5B through 5D can be extended to a complementary circuit having one or more p-type transistors and having transistors other than thin film transistors.

Figure 6A:
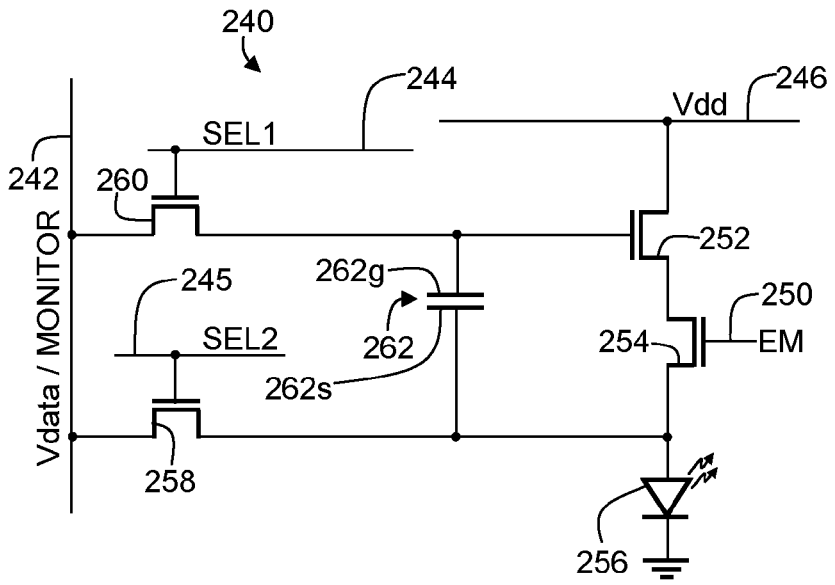
FIG. 6A is a circuit diagram for an exemplary pixel circuit configuration for a pixel.

FIG. 6A is a circuit diagram for an exemplary pixel circuit configuration for a pixel 240. The driving circuit for the pixel 240 is utilized to program, monitor, and drive the pixel 240. The pixel 240 includes a driving transistor 252 for conveying a driving current through an OLED 256. The OLED 256 is similar to the OLED 110 shown in FIG. 2A and emits light according to the current passing through the OLED 256. The OLED 256 can be replaced by any current-driven light emitting device. The pixel 240 can be incorporated into the display panel 20 and the display system 50 described in connection with FIG. 1, with appropriate line connections to the data driver, address driver, monitoring system, etc.

The driving circuit for the pixel 240 also includes a storage capacitor 262, a data switching transistor 260, a monitor transistor 258, and an emission transistor 254. The pixel 240 is coupled to a data/monitor line 242, a voltage supply line 246, a first select line 244, a second select line 245, and an emission line 250. The driving transistor 252 draws a current from the voltage supply line 246 according to a gate-source voltage ("Vgs") across a gate terminal of the driving transistor 252 and a source terminal of the driving transistor 252, and a threshold voltage ("Vt") of the driving transistor 252. The relationship between the drain-source current and the gate-source voltage of the driving transistor 252 is similar to the operation of the driving transistor 114 described in connection with FIGS. 2A and 2B.

In the pixel 240, the storage capacitor 262 is coupled across the gate terminal and the source terminal of the driving transistor 252 through the emission transistor 254. The storage capacitor 262 has a first terminal 262*g*, which is referred to for convenience as a gate-side terminal 262*g*, and a second terminal 262*s*, which is referred to for convenience as a source-side terminal 262*s*. The gate-side terminal 262*g* of the storage capacitor 262 is electrically coupled to the gate terminal of the driving transistor 252. The source-side terminal 262*s* of the storage capacitor 262 is electrically coupled to the source terminal of the driving transistor 252 through the emission transistor 254. Thus, when the emission transistor 254 is turned on, the gate-source voltage Vgs of the driving transistor 252 is the voltage charged on the storage capacitor 262. The emission transistor 254 is operated according to the emission line 250 (e.g., the emission transistor 254 is turned on when the emission line 250 is set high and vice versa). As will be explained further below, the storage capacitor 262 can thereby maintain a driving voltage across the driving transistor 252 during an emission phase of the pixel 240.

The drain terminal of the driving transistor 252 is electrically coupled to the voltage supply line 246. The source terminal of the driving transistor 252 is electrically coupled to an anode terminal of the OLED 256 through the emission transistor 254. A cathode terminal of the OLED 256 can be connected to ground or can optionally be connected to a second voltage supply line, such as a supply line Vss. Thus, the OLED 256 is connected in series with the current path of the driving transistor 252. The OLED 256 emits light according to the current passing through the OLED 256 once a voltage drop across the anode and cathode terminals of the OLED 256 achieves an operating voltage ("$V_{OLED}$") of the OLED 256 similar to the description of the OLED 110 provided in connection with FIGS. 2A and 2B.

The data switching transistor 260 is operated according to the first select line 244 (e.g., when the first select line 244 is high, the data switching transistor 260 is turned on, and when the first select line 244 is set low, the data switching transistor is turned off). The monitor transistor 258 is similarly operated according to the second select line 245. When turned on, the data switching transistor 260 electrically couples the gate-side terminal 262*g* of the storage capacitor 262 to the data/monitor line 242. When turned on, the monitor transistor 258 electrically couples the source-side terminal 218*s* of the storage capacitor 218 to the data/monitor line 242.

Figure 6B:
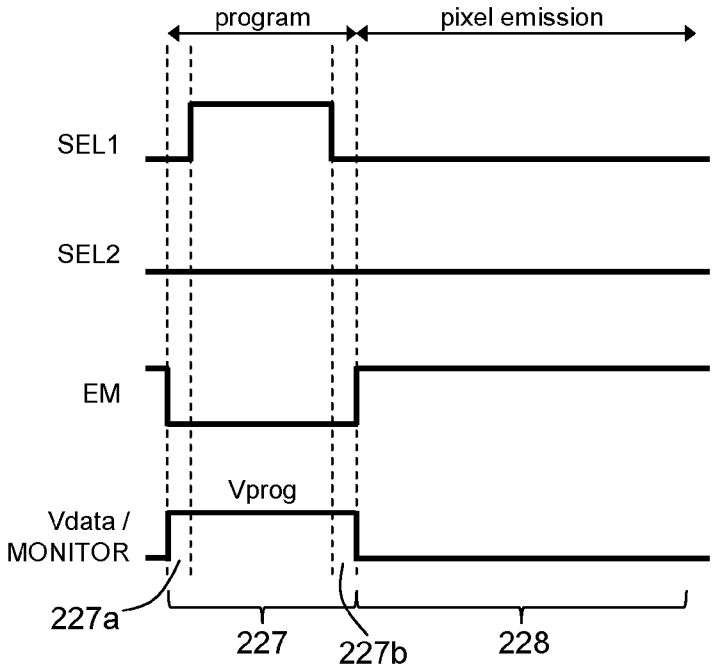
FIG. 6B is a timing diagram for operating the pixel 240 illustrated in FIG. 6A in a program phase and an emission phase.
Figure 6C:
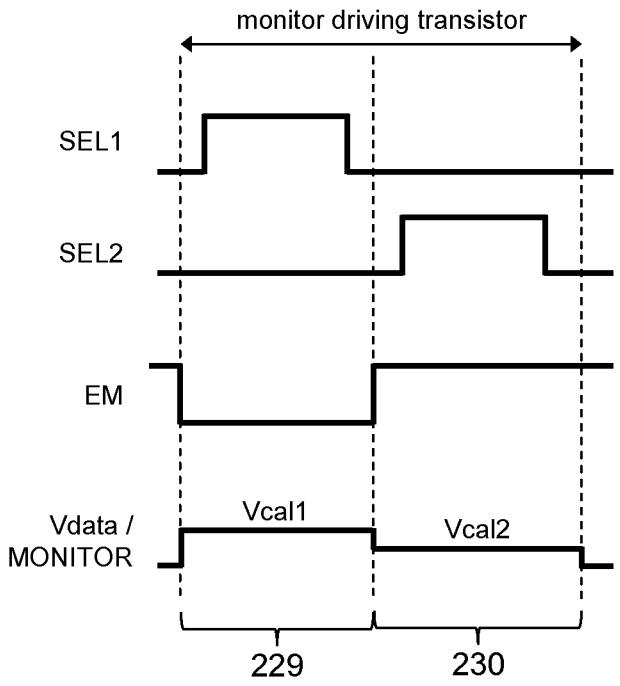
FIG. 6C is a timing diagram for operating the pixel illustrated in FIG. 6A to monitor aspects of the driving transistor.
Figure 6D:
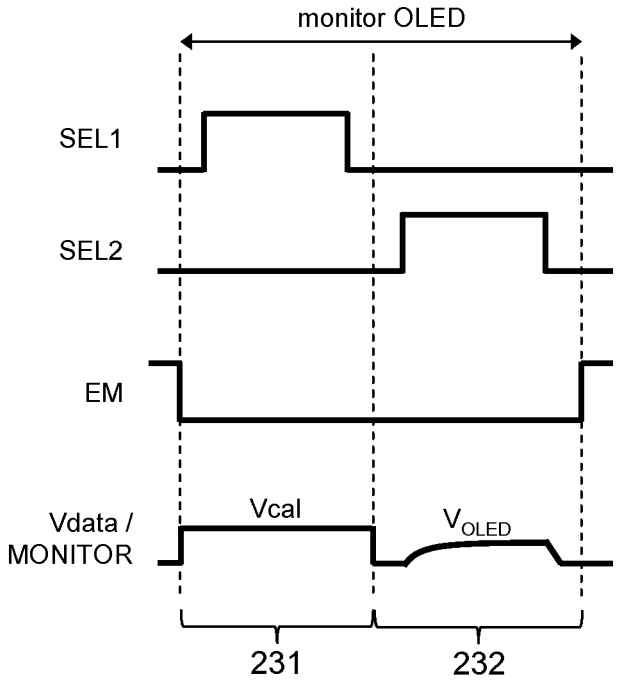
FIG. 6D is a timing diagram for operating the pixel illustrated in FIG. 6A to measure aspects of the OLED.

FIG. 6B is a timing diagram for operating the pixel 240 illustrated in FIG. 6A in a program phase and an emission phase. As shown in FIG. 6B, the pixel 240 can be operated in a program phase 227, and an emission phase 228. FIG. 6C is a timing diagram for operating the pixel 240 illustrated in FIG. 6A to monitor aspects of the driving transistor 252. FIG. 6D is a timing diagram for operating the pixel 240 illustrated in FIG. 6A to measure aspects of the OLED 256.

In an exemplary implementation for operating ("driving") the pixel 240, the pixel 240 may be operated in the program phase 227 and the emission phase 228 for each frame of a video display. The pixel 240 may also optionally be operated in either or both of the monitor phases monitor degradation of the pixel 200 due to the driving transistor 252 or of the OLED 256, or both.

During the program phase 227, the first select line 244 is set high, the second select line 245 is set low, and the emission line 250 is set low. The data switching transistor 260 is turned on while the emission transistor 254 and the monitor transistor 258 are turned off. The data/monitor line 242 is set to a program voltage ("Vprog"). The program voltage Vprog can optionally be adjusted according to compensation information to provide compensation for degradation of the pixel 240. The gate-side terminal 262*g* of the storage capacitor 262 is set to the program voltage Vprog and the source-side terminal 218*s* settles at a voltage corresponding to the anode terminal of the OLED 256 while no current is flowing through the OLED 256. The storage capacitor 262 is thereby charged according to the program voltage Vprog. The voltage charged on the storage capacitor 262 during the program phase 227 is referred to as a driving voltage. The driving voltage is a voltage appropriate to be applied across the driving transistor 252 to generate a desired driving current that will cause the OLED 256 to emit a desired amount of light.

Furthermore, similar to the pixel 160 described in connection with FIGS. 4A and 4B, the emission transistor 254 ensures that the driving transistor 252 is isolated from the storage capacitor 262 during the program phase 227. By disconnecting the source-side terminal 262*s* of the storage capacitor 262 from the driving transistor 252, the emission transistor 254 ensures that the driving transistor 252 is not turned on during programming such that current flows through a switching transistor. As previously discussed, isolating the driving transistor 252 from the storage capacitor 262 via the emission transistor 254 ensures that the voltage charged on the storage capacitor 262 during the program phase 227 is independent of a resistance of a switching transistor.

During the emission phase 228 of the pixel 240, the first select line 244 and the second select line 245 are set low while the emission line 250 is high. The data switching transistor 260 and the monitor transistor 258 are turned off and the emission transistor 254 is turned on during the emission phase 228. By turning on the emission transistor 254, the storage capacitor 262 is connected across the gate terminal and the source terminal of the driving transistor 252. The driving transistor 252 draws a driving current from the voltage supply line 246 according to the driving voltage stored on the storage capacitor 262. The OLED 256 is turned on and the voltage at the anode terminal of the OLED 256 adjusts to the operating voltage $V_{OLED}$ of the OLED 256. The storage capacitor 262 maintains the driving voltage by self-adjusting the voltage of the source terminal and/or gate terminal of the driving transistor 252 so as to account for variations on one or the other. For example, if the voltage on the source-side terminal 262*s* changes during the emission cycle 228 due to, for example, the anode terminal of the OLED 256 settling at the operating voltage $V_{OLED}$, the storage capacitor 262 adjusts the voltage on the gate terminal of the driving transistor 252 to maintain the driving voltage across the gate and source terminals of the driving transistor 252.

A TFT monitor operation includes a charge phase 229 and a read phase 230. During the charge phase 229, the first select line 244 is set high while the second select line 245 and the emission line 250 are set low. Similar to the program phase 227, the gate-side terminal 262*g* of the storage capacitor 262 is charged with a first calibration voltage ("Vcal1") that is applied to the data/monitor line 242. Next, during the read phase 230, the first select line 244 is set low and the second select line 245 and the emission line 250 are set high. The data/monitor line 242 is set to a second calibration voltage ("Vcal2"). The second calibration voltage Vcal2 advantageously reverse biases the OLED 256 such that current flowing through the driving transistor 252 flows to the data/monitor line 242. The data/monitor line 242 is maintained at the second calibration voltage Vcal2 while the current is measured. Comparing the measured current with the first calibration voltage Vcal1 and the second calibration voltage Vcal2 allows for the extraction of degradation information related to the driving transistor 252, similar to the previous descriptions.

An OLED monitor operation also includes a charge phase 231 and a read phase 232. During the charge phase 231, the first select line 244 is set high while the second select line 245 and the emission line 250 are set low. The data switching transistor 260 is turned on and applies a calibration voltage ("Vcal") to the gate-side terminal 262*g* of the storage capacitor 262. During the read phase 232, the current on the data/monitor line 242 is fixed while the voltage is measured to extract the operating voltage ("$V_{OLED}$") of the OLED 256.

The pixel 240 advantageously combines the data line and monitor line in a single line, which allows the pixel 240 to be packaged in a smaller area compared to pixels lacking such a combination, and thereby increase pixel density and display screen resolution.

While the driving circuit illustrated in FIG. 6A is illustrated with n-type transistors, which can be thin-film transistors and can be formed from amorphous silicon, the driving circuit illustrated in FIG. 6A for the pixel 240 and the operating cycles illustrated in FIGS. 6B through 6D can be extended to a complementary circuit having one or more p-type transistors and having transistors other than thin film transistors.

Figure 7A:
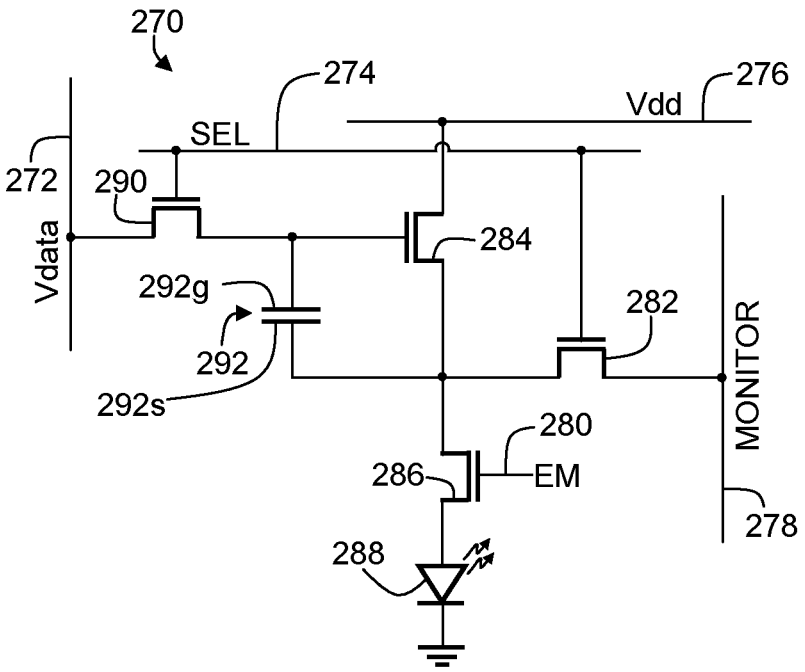
FIG. 7A is a circuit diagram for an exemplary pixel driving circuit for a pixel.

FIG. 7A is a circuit diagram for an exemplary pixel driving circuit for a pixel 270. The pixel 270 is structurally similar to the pixel 100 in FIG. 2A, except that the pixel 270 incorporates an additional emission transistor 286 between the driving transistor 284 and the OLED 288, and except that the configuration of the data line 272 and the monitor line 278 differs from the pixel 100. The emission transistor 286 is also positioned between the storage capacitor 292 and the OLED 288, such that during a program phase of the pixel 270, the storage capacitor 292 can be electrically disconnected from the OLED 288. Disconnecting the storage capacitor 292 from the OLED 288 during programming prevents the programming of the storage capacitor 292 from being influenced or perturbed due to the capacitance of the OLED 288. In addition to the differences introduced by the emission transistor 286 and the configuration of the data and monitor lines, the pixel 270 can also operate differently than the pixel 100, as will be described further below.

Figure 7B:
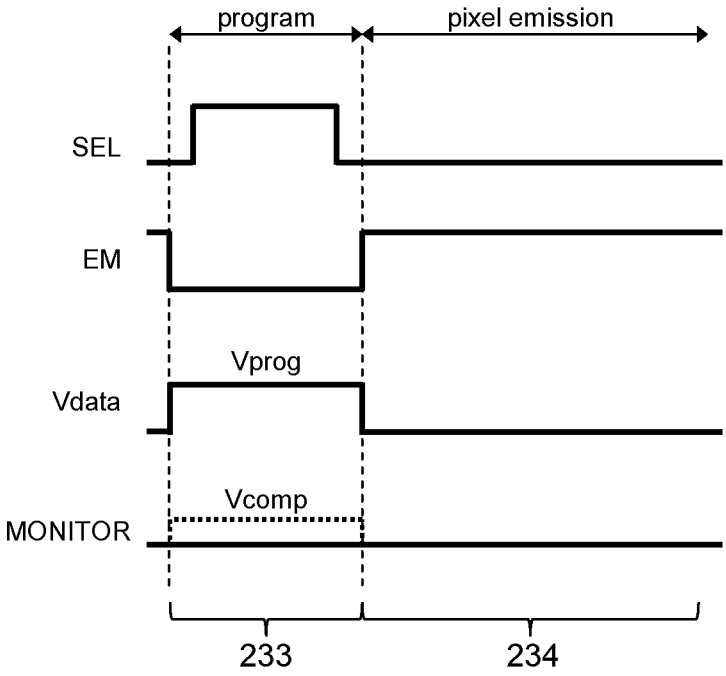
FIG. 7B is a timing diagram for operating the pixel illustrated in FIG. 7A in a program phase and an emission phase.
Figure 7C:
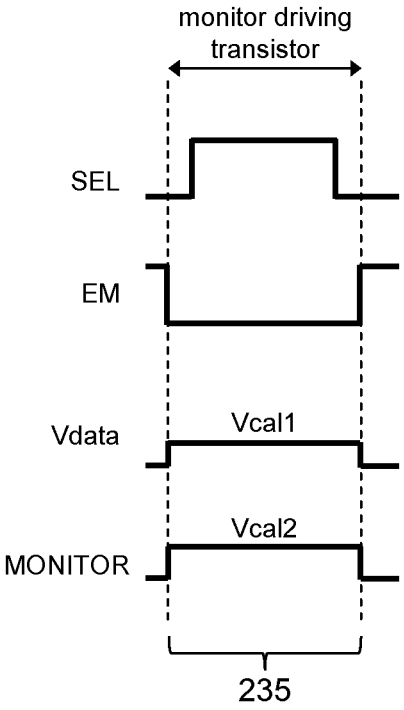
FIG. 7C is a timing diagram for operating the pixel illustrated in FIG. 7A in a TFT monitor phase to measure aspects of the driving transistor.
Figure 7D:
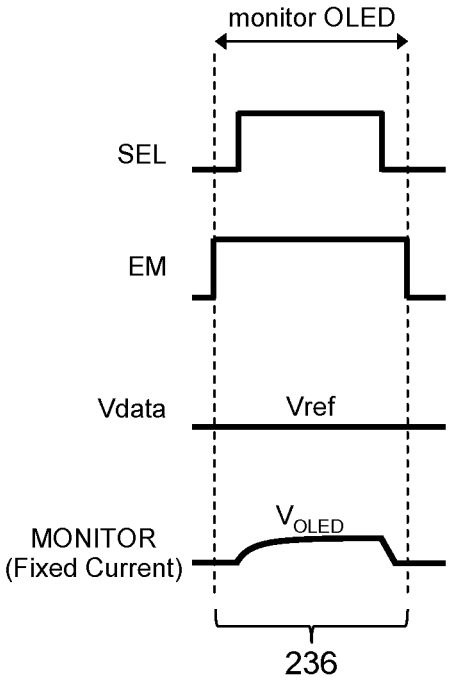
FIG. 7D is a timing diagram for operating the pixel illustrated in FIG. 7A in an OLED monitor phase to measure aspects of the OLED.

FIG. 7B is a timing diagram for operating the pixel 270 illustrated in FIG. 7A in a program phase and an emission phase. As shown in FIG. 7B, the pixel 270 can be operated in a program phase 233, and an emission phase 234. FIG. 7C is a timing diagram for operating the pixel 270 illustrated in FIG. 7A in a TFT monitor phase 235 to measure aspects of the driving transistor 284. FIG. 7D is a timing diagram for operating the pixel 270 illustrated in FIG. 7A in an OLED monitor phase 236 to measure aspects of the OLED 288.

In an exemplary implementation for operating ("driving") the pixel 270, the pixel 270 may be operated with a program phase 233 and an emission phase 234 for each frame of a video display. The pixel 270 may also optionally be operated in either or both of the monitor phases 235, 236 to monitor degradation of the pixel 270 due to the driving transistor 284 or of the OLED 288, or both. The pixel 270 may be operated in the monitor phase(s) 235, 236 intermittently, periodically, or according to a sorting and prioritization algorithm to dynamically determine and identify pixels in a display that require updated degradation information for providing compensation therefore. Therefore, a driving sequence corresponding to a single frame being displayed via the pixel 270 can include the program phase 233 and the emission phase 234, and can optionally either or both of the monitor phases 235, 236.

During the program phase 233, the select line 274 is set high and the emission line 280 is set low. The data switching transistor 290 and the monitor transistor 282 are turned on while the emission transistor 286 is turned off. The data line 272 is set to a program voltage ("Vprog") and the monitor line 278 is fixed at a reference voltage ("Vref"). The monitor line 278 can optionally be set to a compensation voltage ("Vcomp") rather than the reference voltage Vref. The gate-side terminal 292*g* of the storage capacitor 292 is set to the program voltage Vprog and the source-side terminal 292*s* is set to the reference voltage Vref (or the compensation voltage Vcomp). The storage capacitor 292 is thereby charged according to the difference between the program voltage Vprog and the reference voltage Vref (or the compensation voltage Vcomp). The voltage charged on the storage capacitor 292 during the program phase 233 is referred to as a driving voltage. The driving voltage is a voltage appropriate to be applied across the driving transistor to generate a desired driving current that will cause the OLED 288 to emit a desired amount of light. Similar to the operation of the pixel 100 described in connection with FIGS. 2A and 2B, the compensation voltage Vcomp optionally applied to the source-side terminal 292*s* is a proper voltage to account for a degradation of the pixel circuit 270, such as the degradation measured during the monitor phase(s) 235, 236 (e.g., an increase in the threshold voltage Vt of the driving transistor 284). Additionally or alternatively, compensation for degradation of the pixel 270 can be accounted for by adjustments to the program voltage Vprog applied to the gate-side terminal 292*g*.

During the emission phase 234 of the pixel 270, the select line 274 is set low while the emission line 280 is high. The data switching transistor 290 and the monitor transistor 282 are turned off and the emission transistor 286 is turned on during the emission phase 234. By turning on the emission transistor 286, the storage capacitor 292 is connected across the gate terminal and the source terminal of the driving transistor 284. The driving transistor 284 draws a driving current from the voltage supply line 276 according to the driving voltage stored on the storage capacitor 292. The OLED 288 is turned on and the voltage at the anode terminal of the OLED 288 adjusts to the operating voltage $V_{OLED}$ of the OLED 288. The storage capacitor 292 maintains the driving voltage by self-adjusting the voltage of the source terminal and/or gate terminal of the driving transistor 284 so as to account for variations on one or the other. For example, if the voltage on the source-side terminal 292*s* changes during the emission cycle 234 due to, for example, the anode terminal of the OLED 288 settling at the operating voltage $V_{OLED}$, the storage capacitor 292 adjusts the voltage on the gate terminal of the driving transistor 284 to maintain the driving voltage across the gate and source terminals of the driving transistor 284.

During the TFT monitor phase 235 of the pixel 270, the select line 274 is set high while the emission line 280 is set low. The data switching transistor 290 and the monitor transistor 282 are turned on while the emission transistor 286 is turned off. The data line 272 is fixed at a first calibration voltage ("Vcal1"), and the monitor line 278 is fixed at a second calibration voltage ("Vcal2"). The first calibration voltage Vcal1 is applied to the gate terminal of the driving transistor 284 through the data switching transistor 290. The second calibration voltage Vcal2 is applied to the source terminal of the driving transistor 284 through the monitor transistor 282. The first calibration voltage Vcal1 and the second calibration voltage Vcal2 thereby fix the gate-source potential Vgs of the driving transistor 284 and the driving transistor 284 draws a current from the voltage supply line 276 according to its gate-source potential Vgs. The emission transistor 286 is turned off, which removes the OLED 288 from the current path of the driving transistor 284 during the TFT monitor phase 235. The current from the driving transistor 284 is thus conveyed to the monitor line 278 via the monitor transistor 282. Similar to the description of the monitoring phase 121 in connection with the pixel 100 in FIGS. 2A and 2B, the current measured on the monitor line 278 can be used to extract degradation information for the pixel 270, such as information indicative of the threshold voltage Vt of the driving transistor 284.

During the OLED monitor phase 236 of the pixel 270, the select line 274 and the emission line 280 are set high. The data switching transistor 290, the monitor transistor 282, and the emission transistor 286 are all turned on. The data line 272 is fixed at a reference voltage Vref, and the monitor line sources or sinks a fixed current on the monitor line 278. The fixed current on the monitor line 278 is applied to the OLED 288 through the monitor transistor 282, and causes the OLED 288 to settle at its operating voltage $V_{OLED}$. Thus, by applying a fixed current to the monitor line 278, and measuring the voltage of the monitor line 278, the operating voltage $V_{OLED}$ of the OLED 288 can be extracted.

While the driving circuit illustrated in FIG. 7A is illustrated with n-type transistors, which can be thin-film transistors and can be formed from amorphous silicon, the driving circuit illustrated in FIG. 7A for the pixel 270 and the operating cycles illustrated in FIGS. 7B through 7D can be extended to a complementary circuit having one or more p-type transistors and having transistors other than thin film transistors.

Circuits disclosed herein generally refer to circuit components being connected or coupled to one another. In many instances, the connections referred to are made via direct connections, i.e., with no circuit elements between the connection points other than conductive lines. Although not always explicitly mentioned, such connections can be made by conductive channels defined on substrates of a display panel such as by conductive transparent oxides deposited between the various connection points. Indium tin oxide is one such conductive transparent oxide. In some instances, the components that are coupled and/or connected may be coupled via capacitive coupling between the points of connection, such that the points of connection are connected in series through a capacitive element. While not directly connected, such capacitively coupled connections still allow the points of connection to influence one another via changes in voltage which are reflected at the other point of connection via the capacitive coupling effects and without a DC bias.

Furthermore, in some instances, the various connections and couplings described herein can be achieved through non-direct connections, with another circuit element between the two points of connection. Generally, the one or more circuit element disposed between the points of connection can be a diode, a resistor, a transistor, a switch, etc. Where connections are non-direct, the voltage and/or current between the two points of connection are sufficiently related, via the connecting circuit elements, to be related such that the two points of connection can influence each another (via voltage changes, current changes, etc.) while still achieving substantially the same functions as described herein. In some examples, voltages and/or current levels may be adjusted to account for additional circuit elements providing non-direct connections, as can be appreciated by individuals skilled in the art of circuit design.

Any of the circuits disclosed herein can be fabricated according to many different fabrication technologies, including for example, poly-silicon, amorphous silicon, organic semiconductor, metal oxide, and conventional CMOS. Any of the circuits disclosed herein can be modified by their complementary circuit architecture counterpart (e.g., n-type transistors can be converted to p-type transistors and vice versa).

Two or more computing systems or devices may be substituted for any one of the controllers described herein. Accordingly, principles and advantages of distributed processing, such as redundancy, replication, and the like, also can be implemented, as desired, to increase the robustness and performance of controllers described herein.

The operation of the example determination methods and processes described herein may be performed by machine readable instructions. In these examples, the machine readable instructions comprise an algorithm for execution by: (a) a processor, (b) a controller, and/or (c) one or more other suitable processing device(s). The algorithm may be embodied in software stored on tangible media such as, for example, a flash memory, a CD-ROM, a floppy disk, a hard drive, a digital video (versatile) disk (DVD), or other memory devices, but persons of ordinary skill in the art will readily appreciate that the entire algorithm and/or parts thereof could alternatively be executed by a device other than a processor and/or embodied in firmware or dedicated hardware in a well known manner (e.g., it may be implemented by an application specific integrated circuit (ASIC), a programmable logic device (PLD), a field programmable logic device (FPLD), a field programmable gate array (FPGA), discrete logic, etc.). For example, any or all of the components of the baseline data determination methods could be implemented by software, hardware, and/or firmware. Also, some or all of the machine readable instructions represented may be implemented manually.

While particular embodiments and applications of the present invention have been illustrated and described, it is to be understood that the invention is not limited to the precise construction and compositions disclosed herein and that various modifications, changes, and variations can be apparent from the foregoing descriptions without departing from the spirit and scope of the invention as defined in the appended claims.

What is claimed is:

1. A system for compensating a pixel in a display array, the system comprising:

a pixel circuit for being programmed according to programming information, during a programming cycle, and driven to emit light according to the programming information, during an emission cycle, the pixel circuit comprising:

a light emitting device for emitting light during the emission cycle, a driving transistor for conveying current through the light emitting device during the emission cycle, a storage capacitor for being charged with a voltage based at least in part on the programming information, during the programming cycle, and an emission control transistor coupled to at least two of the light emitting device, the driving transistor, and the storage capacitor, and for disconnecting said at least two of the driving transistor, the light emitting device, and the storage capacitor, such that a perturbation of the charging of the storage capacitor during the programming cycle by at least one of the driving transistor and the light emitting device is prevented, the storage capacitor and the emission control transistor coupled in series and coupled directly to a node between the driving transistor and the light emitting device;

a driver for programming the pixel circuit via a data line by charging the storage capacitor according to the programming information; and a controller for operating the driver and configured to:

receive a data input indicative of an amount of luminance to be emitted from the light emitting device; and provide the programming information to the driver to program the pixel circuit, wherein the programming information is based at least in part on the received data input.

2. The system according to claim 1, wherein the emission control transistor is further for connecting said at least two of the driving transistor, the light emitting device, and the storage capacitor, such that current is conveyed through the driving transistor and the light emitting device, during an emission cycle, according to voltage charged on the storage capacitor.

3. The system according to claim 1, wherein perturbation of the charging of the storage capacitor during the programming cycle caused by a capacitance of the light emitting device is prevented, and the pixel circuit is programmed independent of the capacitance of the light emitting device.

4. The system according to claim 3, wherein the emission control transistor is coupled between the storage capacitor and the light emitting device, said at least two of the driving transistor, the light emitting device, and the storage capacitor comprising the storage capacitor and the light emitting device.

5. The system according to claim 1, wherein perturbation of the charging of the storage capacitor during the programming cycle caused by current generated by the driving transistor is prevented.

6. The system according to claim 5, wherein perturbation of the charging of the storage capacitor during the programming cycle caused by a shift in voltage applied to a terminal of the storage device due to current generated by the driving transistor flowing through a further circuit element is prevented.

7. The system according to claim 6, wherein the further circuit element comprises a switch transistor and the pixel circuit is programmed independent of a resistance of the switch transistor.

8. The system according to claim 5, wherein the emission control transistor is coupled between the storage capacitor and the driving transistor, said at least two of the driving transistor, the light emitting device, and the storage capacitor comprising the storage capacitor and the driving transistor.

9. The system according to claim 1, further comprising a monitor for extracting a voltage or a current indicative of degradation of the pixel circuit during a monitoring cycle, wherein the pixel circuit further comprises at least one switch transistor for connecting a current path through the driving transistor to the monitor during the monitoring cycle, and wherein the controller is further for operating the monitor and is further configured to:

receive an indication of the amount of degradation from the monitor; and determine an amount of compensation to provide to the pixel circuit based on the amount of degradation;

wherein the programming information further is based at least in part on the determined amount of compensation.

10. The pixel circuit according to claim 9, further comprising:

a data switch transistor, operated according to a select line, for coupling, during the programming cycle, the data line to a terminal of the storage capacitor; and wherein the at least one switch transistor is a monitoring switch transistor, operated according to the select line or another select line, for conveying the current or voltage indicative of the degradation of the pixel circuit to the monitor, during the monitoring cycle.

11. The system according to claim 1, wherein the light emitting device comprises an organic light emitting diode.

12. A pixel circuit for driving a light emitting device, the pixel circuit comprising:

a driving transistor for driving current through a light emitting device according to a driving voltage applied across the driving transistor;

a storage capacitor for being charged, during a programming cycle, with the driving voltage; and an emission control transistor coupled to at least two of the driving transistor, the light emitting device, and the storage capacitor and for disconnecting said at least two of the driving transistor, the light emitting device, and the storage capacitor, such that a perturbation of the charging of the storage capacitor during the programming cycle by at least one of the driving transistor and the light emitting device is prevented the storage capacitor and the emission control transistor coupled in series and coupled directly to a node between the driving transistor and the light emitting device.

13. The pixel circuit according to claim 12, wherein the emission control transistor is further for connecting said at least two of the driving transistor, the light emitting device, and the storage capacitor, such that current is conveyed through the driving transistor and the light emitting device, during an emission cycle, according to voltage charged on the storage capacitor.

14. The pixel circuit according to claim 12, wherein perturbation of the charging of the storage capacitor during the programming cycle caused by a capacitance of the light emitting device is prevented, and the pixel circuit is programmed independent of the capacitance of the light emitting device.

15. The pixel circuit according to claim 14, wherein the emission control transistor is coupled between the storage capacitor and the light emitting device, said at least two of the driving transistor, the light emitting device, and the storage capacitor comprising the storage capacitor and the light emitting device.

16. The pixel circuit according to claim 12, wherein perturbation of the charging of the storage capacitor during the programming cycle caused by current generated by the driving transistor is prevented.

17. The pixel circuit according to claim 16, wherein perturbation of the charging of the storage capacitor during the programming cycle caused by a shift in voltage applied to a terminal of the storage device due to current generated by the driving transistor flowing through a further circuit element is prevented.

18. The pixel circuit according to claim 17, wherein the further circuit element comprises a switch transistor and the pixel circuit is programmed independent of a resistance of the switch transistor.

19. The pixel circuit according to claim 16, wherein the emission control transistor is coupled between the storage capacitor and the driving transistor, said at least two of the driving transistor, the light emitting device, and the storage capacitor comprising the storage capacitor and the driving transistor.

20. The pixel circuit according to claim 12, further comprising at least one switch transistor for connecting a current path through the driving transistor to a monitor for extracting a voltage or a current indicative of degradation of the pixel circuit, during a monitoring cycle.

21. The pixel circuit according to claim 20, further comprising:

a data switch transistor, operated according to a select line, for coupling, during the programming cycle, a data line to a terminal of the storage capacitor; and wherein the at least one switch transistor is a monitoring switch transistor, operated according to the select line or another select line, for conveying the current or voltage indicative of the degradation of the pixel circuit to the monitor, during the monitoring cycle.

22. The pixel circuit according to claim 21, wherein the light emitting device comprises an organic light emitting diode.

* * * * *